US007144198B2

(12) United States Patent
Hirose et al.

(10) Patent No.: US 7,144,198 B2
(45) Date of Patent: Dec. 5, 2006

(54) DIVER INFORMATION PROCESSING APPARATUS AND METHOD OF CONTROLLING SAME

(75) Inventors: Takeshi Hirose, Suwa (JP); Naoshi Furuta, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/927,053

(22) Filed: Aug. 27, 2004

(65) Prior Publication Data

US 2005/0095067 A1 May 5, 2005

(30) Foreign Application Priority Data

Aug. 29, 2003 (JP) ..... 2003-307311
Feb. 9, 2004 (JP) ..... 2004-031582
Aug. 13, 2004 (JP) ..... 2004-235938

(51) Int. Cl.
*B63C 11/02* (2006.01)

(52) U.S. Cl. ..... 405/186

(58) Field of Classification Search ..... 405/186
See application file for complete search history.

(56) References Cited

U.S. PATENT DOCUMENTS 3,992,948 A * 11/1976 D'Antonio et al. ..... 73/865.1
4,336,591 A * 6/1982 Berdzar et al. ..... 73/865.1
4,999,606 A * 3/1991 Comerford et al. ..... 73/865.1
5,570,688 A * 11/1996 Cochran et al. ..... 73/865.1
5,617,848 A * 4/1997 Cochran ..... 128/205.23
5,737,246 A * 4/1998 Furukawa et al. ..... 702/166
5,794,616 A * 8/1998 Cochran et al. ..... 128/205.11
5,899,204 A * 5/1999 Cochran ..... 128/205.23
6,334,440 B1 * 1/2002 Cochran ..... 128/201.27
6,762,678 B1 * 7/2004 Arens ..... 340/506
6,856,578 B1 * 2/2005 Magine et al. ..... 367/134

FOREIGN PATENT DOCUMENTS

JP H02-193015 A 7/1990
JP 06289166 A 10/1994
JP 10338193 A 12/1998
JP H10-316090 A 12/1998
JP H10-338193 A 12/1998

* cited by examiner

*Primary Examiner*—Frederick L. Lagman
(74) *Attorney, Agent, or Firm*—Global IP Counselors, LLP

(57) ABSTRACT

To provide safety-ensuring information that is considered to enhance safety in accordance with the movement of the diver's body in the water. An information processing device is provided that is worn on the diver, and has an external sensor unit 5 to measure environment information around the wearing location and to transmit environment information data, and a dive computer 4 to receive environment information data from the external sensor unit 5 and to generate and to output safety-ensuring information to ensure the safety of the diver on the basis of the environment information corresponding to the environment information data.

27 Claims, 16 Drawing Sheets

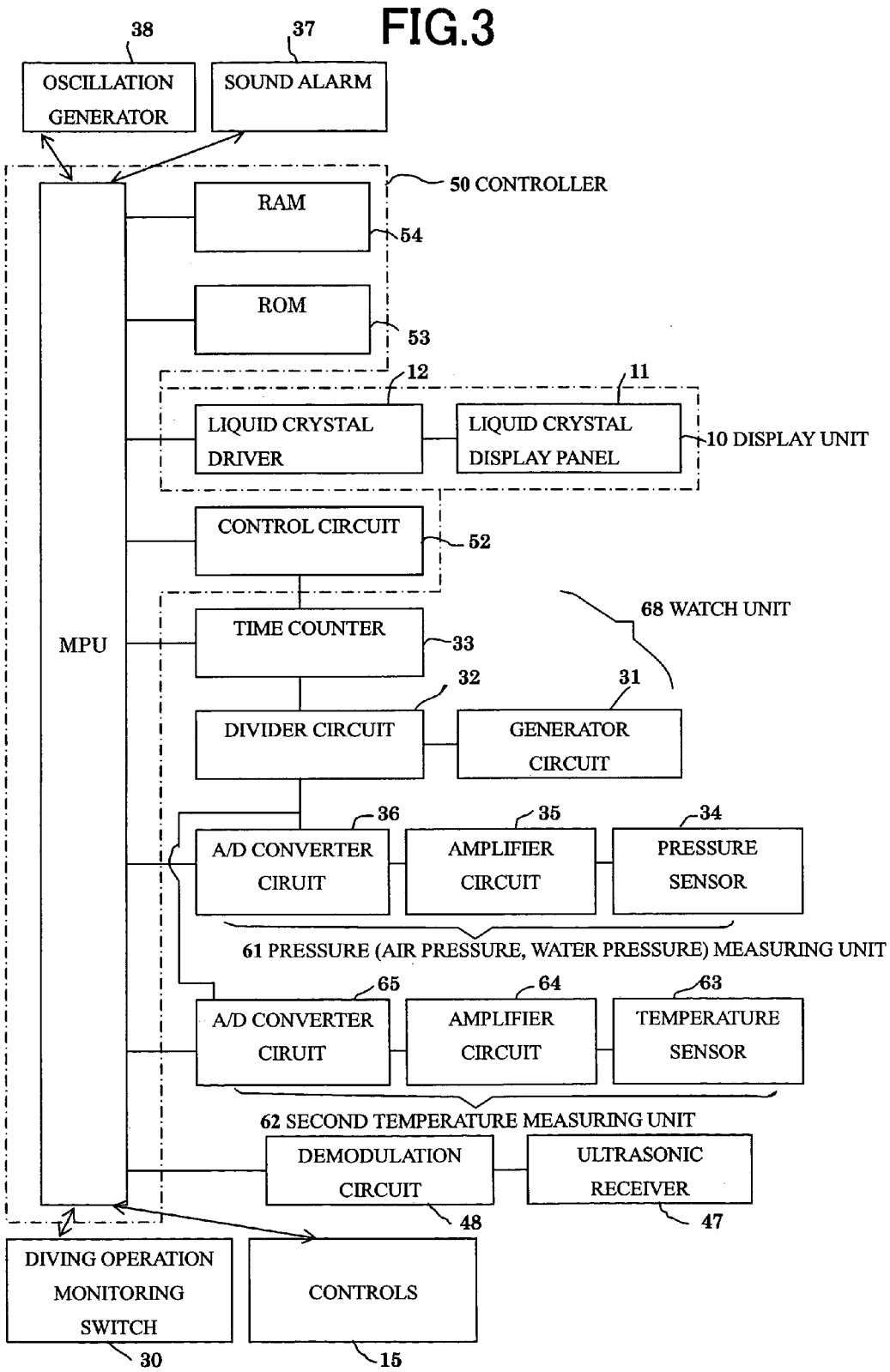
FIG.3
38
OSCILLATION GENERATOR
37
SOUND ALARM
50 CONTROLLER
RAM
54
ROM
53
12
11
LIQUID CRYSTAL DRIVER
LIQUID CRYSTAL DISPLAY PANEL
10 DISPLAY UNIT
CONTROL CIRCUIT
52
68 WATCH UNIT
MPU
TIME COUNTER
33
32
31
DIVIDER CIRCUIT
GENERATOR CIRCUIT
36
35
34
A/D CONVERTER CIRUIT
AMPLIFIER CIRCUIT
PRESSURE SENSOR
61 PRESSURE (AIR PRESSURE, WATER PRESSURE) MEASURING UNIT
65
64
63
A/D CONVERTER CIRUIT
AMPLIFIER CIRCUIT
TEMPERATURE SENSOR
62 SECOND TEMPERATURE MEASURING UNIT
DEMODULATION CIRCUIT
ULTRASONIC RECEIVER
48
47
DIVING OPERATION MONITORING SWITCH
CONTROLS
30
15

FIG.9

| | WATER TEMPERATURE | | | |
|---|---|---|---|---|
| | -5～5℃ | 5.1～15℃ | 15.1～25℃ | 25.1°C OR HIGHER |
| REFERENCE ASCENT VELOCITY | 0.8 | 0.9 | 1 | 0.9 |
| TIME DURING WHICH NON-DECOMPRESSION DIVING IS POSSIBLE | 0.8 | 0.9 | 1 | 0.9 |

DIVER INFORMATION PROCESSING APPARATUS AND METHOD OF CONTROLLING SAME

TECHNICAL FIELD

The present invention relates to an information processing device for a diver, a control method therefor, and a control program.

PRIOR ART

The method to calculate the decompression conditions after diving, which is carried out in a stand-alone safety information reporting device for a diver and is referred to as a dive computer, is described in detail in "Dive Computers: A Consumer's Guide to History, Theory, and Performance" written by Ken Loyst, et al. (Watersport Publishing Inc., (1991)). The theory is outlined in detail in "Decompression-Decompression Sickness" written by A. A. Buhlmann (Springer, Berlin (1984)) (page 14 in particular), for example. It is indicated in both of these references that inert gas absorbed in the body through diving invites decompression sickness. Herein discussed are calculations based on the equations below, which are cited on page 14 of "Decompression-Decompression Sickness" by A. A. Buhlmann (Springer, Berlin (1984)), from the aspect of preventing decompression sickness with greater reliability.

$$Pigt(tE)=Pigt(t0)+\{PIig-Pigt(t0)\}\times\{1-\exp(-ktE)\}$$

In the equation, Pigt(tE) is the partial pressure of inert gas in the body after time tE, Pigt(t0) is the partial pressure of inert gas in the body at time t0, PIig is the partial pressure of inert gas in the respiratory air, and "k" is a constant that is determined by the half saturation time.

In accordance with this equation, when Pigt(t0)<PIig, the partial pressure Pigt(tE) of inert gas in the body increases; in other words, inert gas is being absorbed by the body, and when Pigt(to)>PIig, the partial pressure Pigt(tE) of inert gas in the body decreases, that is to say, inert gas is being purged from the body.

In other words, absorbing/purging inert gas into and from the body is determined by the magnitude of the relationship between the partial pressure of inert gas in the body and the inert gas of the respiratory air, irrespective of whether the diver is ascending or descending. Therefore, if the amount of inert gas in the body is understood from the magnitude of the relationship, it is possible to determine the time required for the amount of inert gas in the body to return to a normal state after diving, in other words, the time the diver should spend on the surface until the next dive, so the diver can be protected from decompression sickness, and the number of dives, which was conventionally twice per day, can be increased through the use of a diving history. Also, from the aspect of preventing decompression sickness, it is also important to maintain ascent velocity to the surface.

In view of the above, conventional safety information reporting devices for a diver calculate the required information (in other words, safety-ensuring information) to ensure the safety of the diver with a predetermined algorithm, the time and safe ascent velocity until the inert gas excessively accumulated in the body is purged, for example, and display the results on a liquid crystal display panel or other display (Patent Reference 1, for example).

Patent Reference 1
Japanese Laid-Open Patent Application No. 10-338193
Patent Reference 2
Japanese Laid-Open Patent Application No. 6-289166

DISCLOSURE OF THE INVENTION

Problems the Invention Is Intended to Solve

However, in the above-described conventional dive computer, depth is calculated with a sensor housed in the dive computer, so safety information is calculated using the location where the dive computer is worn, such as the arm position.

It should be noted that in actual diving the wrist may be raised when the diver is surfacing or moving around under the surface, and in such a case, a situation may occur in which the actual position of the diver's body is at a higher depth than the position of the arm, creating a condition that is not conducive to safety.

There are also cases in which the diver's body moves up and down in the water when the diver grasps onto a rope or ledge solely with the arm, and in such a case, a difference is created not only in the depth, but also in the ascent velocity.

In view of the above, and based on the disclosure of the present invention, it is apparent to those skilled in the art that a need exists for an improved multifunctional watch. The present invention has been developed in response to such needs of the prior art and to other needs, which will become apparent to those skilled in the art from the disclosure given below.

An object of the present invention is to provide an information processing device for a diver that can provide what is considered to be enhanced safety-ensuring information in accordance with the movement of the diver's body in the water, a control method thereof, and a control program and recording device.

Means Used to Solve the Above-Mentioned Problems

In order to solve the above-described problems, the information processing device worn by a diver has an environment information measuring unit which is worn in the first wearing location on the diver and which measures environment information and transmits environment information data; and a safety-ensuring information generating unit which is worn by the diver in a second location that is different from the first wearing location and which receives environment information data from the environment information measuring unit, and generates and outputs safety-ensuring information to ensure the safety of the diver on the basis of the environment information data.

In accordance with the above configuration, the environment information measuring unit measures environment information in the area of the wearing position, and transmits the environment information data.

The safety-ensuring information generating unit receives environment information data from the environment information measuring unit, and generates and outputs the safety-ensuring information to ensure the safety of the diver on the basis of the environment information that corresponds to the environment information data.

In this case, the safety-ensuring information generating unit may be provided with a measuring unit, which is worn in a different location than the environment information measuring unit and which measures environment data in the area of the wearing location, and the safety-ensuring information is generated and output on the basis of environment information that corresponds to the received environment information data and the environment information measured with the measuring unit.

A plurality of environment information measuring units worn at mutually differing locations are provided and the safety-ensuring information generating unit may be configured to generate and output safety-ensuring information that provides maximum safety from among the types of safety-ensuring information that are expected to be obtained for each wearing location or for each group obtained by dividing a plurality of wearing locations into a plurality of groups.

Furthermore, the environment information may be depth, pressure, or temperature.

The environment information measuring unit has a transmitter unit to transmit wirelessly the environment information data by ultrasonic waves or light to the safety-ensuring information generating unit, and the safety-ensuring information generating unit may be configured with a receiver unit to receive the environment information data.

Also, the environment information measuring unit may also be configured to measure the environment information at predetermined cycles and to transmit the environment-measured data.

The configuration may be one in which the environment information is the ambient water temperature, the environment information measuring unit has a temperature sensor to measure the ambient water temperature, and the information processing device for a diver has a temperature storage control unit to store as log information or profile information temperature information that corresponds to the output of the temperature sensor after the measured temperature output acquired from the temperature sensor has reached a stable state.

The configuration may be one in which the environment information is the ambient water temperature, the environment information measuring unit has a temperature sensor to measure the water temperature in the area corresponding to the wearing position of the measuring unit, and the information processing device for a diver has a temperature storage control unit to store as log information or profile information temperature information that corresponds to the output of the temperature sensor after the measured temperature output acquired from the temperature sensor has reached a stable state.

The temperature storage control unit may be configured to conclude that a stable condition has been reached once a preset acclimation time in correlation with the temperature sensor has elapsed.

The temperature storage control unit may be configured to conclude that a stable condition has been reached in a state in which the output of the temperature sensor has reached a normal water temperature value.

The temperature storage control unit may be configured to conclude that a stable condition has been reached when the output of the temperature sensor has reached a state corresponding to normal water temperature value.

The temperature storage control unit may be configured to conclude that a stable condition has been reached when the amount of temperature displacement of the measured temperature per unit of time is equal to or less than a reference amount of temperature displacement.

The temperature storage control unit may be configured so store as log information or profile information temperature information that corresponds to the lowest water temperature, or temperature information that corresponds to the water temperature at the maximum depth after a stable state has been reached.

The temperature storage control unit may be configured to prevent the storage of temperature information as log information or profile information until a stable state has been reached.

The temperature storage control unit may be configured to store progressively as log information or profile information temperature information that corresponds to the output of the temperature sensor until a stable state has been reached.

The control program to control the information processing device for a diver with a computer measures the environment information in an area with a plurality of measurement target locations, and generates safety-ensuring information to ensure the safety of the diver on the basis of a plurality of types of environment information.

In this case, the configuration may be one in which the environment information is the ambient water temperature, and the water temperature is stored as log information or profile information after the measurement results of the ambient water temperature have reached a stable state. The control programs may also be recorded on a computer-readable recording medium.

EFFECTS OF THE INVENTION

In accordance with the present invention, safety-ensuring information that is considered to provide greater safety in accordance with the movement of the diver's body in the water can be provided.

BRIEF DESCRIPTION OF THE DRAWINGS

The objects, features, advantages, and other characteristics of the present invention will become apparent to those skilled in the art from the description of the present invention given below. Together with the accompanying drawings, the description of the invention that follows is designed to disclose the preferred embodiments of the invention.

FIG. 3 is a schematic block diagram of the dive computer;

FIG. 9 is an example of a compensation coefficient table derived from the ambient water temperature;

KEY TO SYMBOLS

1 . . . tank unit; 1A, 1B tanks; 2 switching valve/regulator; 3 a depth/residual pressure gauge; 4 . . . an information processing device for a diver (dive computer); 5, 5A . . . external sensor unit; 15 . . . controls; 10 . . . display unit; 11 . . . liquid crystal display panel; 12 . . . liquid crystal driver; 15 . . . controls; 30 . . . diving operation monitoring switch; 37 . . . sound alarm; 38 . . . oscillation generator; 41 . . . pressure sensor; 42 . . . amplifier circuit; 43 . . . A/D converter circuit; 44 . . . controller; 45 . . . timing circuit; 46 . . . ultrasonic wave transmitter unit; 47 . . . ultrasonic wave receiver unit; 48 . . . demodulator circuit; 50 . . . control unit; 51 . . . MPU; 53 . . . ROM; 54 . . . RAM; 61 . . . pressure gauge; 62 . . . temperature measuring unit; 63 . . . pressure sensor; 64 . . . amplifier circuit; 65 . . . A/D converter circuit; 68 . . . timer; 75 . . . ascent velocity measuring unit; 76 . . . reference ascent velocity data; 77 . . . ascent velocity violation determining unit; 78 . . . diving results storage unit; 79 . . . ascent/descent controller; 80 . . . information display unit; 81 . . . notification unit; 91 . . . unit to calculate the partial pressure of nitrogen in respiratory air; 92 . . . unit to store the partial pressure of nitrogen in respiratory air; 93 . . . comparison unit; 94 . . . half saturation time selection unit; 95 . . . unit to calculate the partial pressure of nitrogen gas in the body; 96 . . . unit to store the partial pressure of nitrogen gas in the body; 97 . . . unit to derive the partial pressure of nitrogen gas in the body; 98 . . . unit to derive the allowable dive time; and 100 . . . diving apparatus.

BEST MODE FOR CARRYING OUT THE INVENTION

Figure 1:
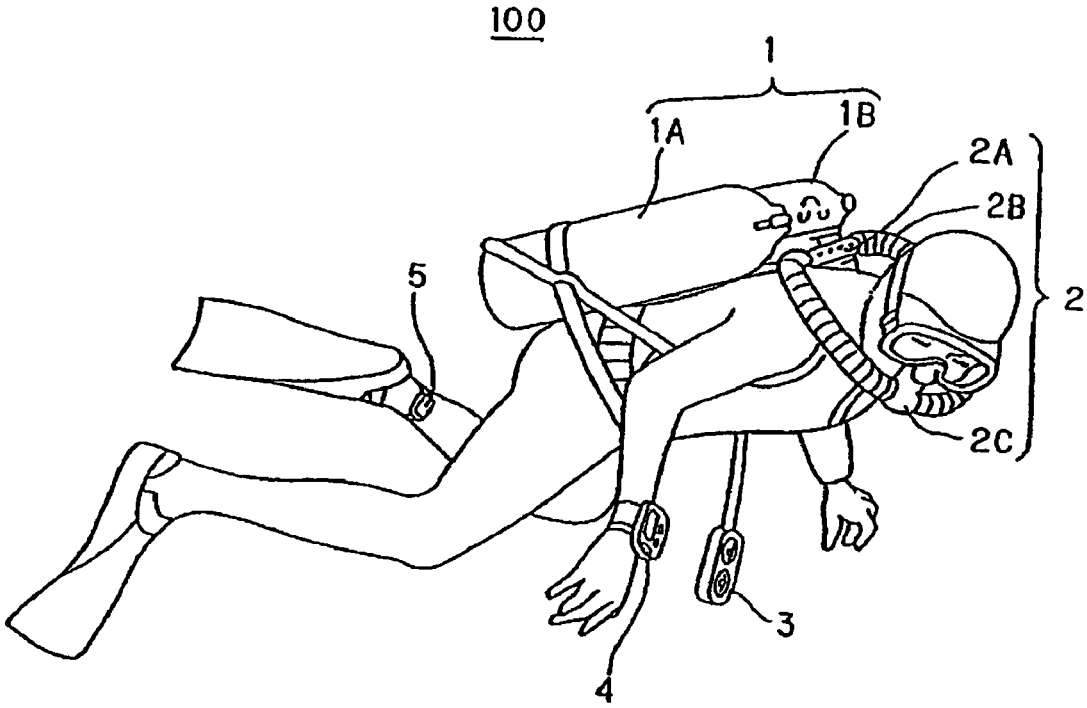
FIG. 1 is a diagram illustrating the manner in which diving equipment is used when an information processing device for a diver according to the embodiments is employed.

FIG. 1 is a diagram illustrating the manner in which diving equipment is used when the information processing device for a diver according to the embodiments is employed.

In broad terms, the diving apparatus 100 has a tank unit 1 with a plurality of tanks 1A to 1B, a switching valve/regulator 2, a depth/residual pressure gauge 3, an information processing device for a diver (hereinafter referred to as "dive computer") 4, and an external sensor unit 5.

Here, for simplicity of description, the case in which a single external sensor unit 5 is worn on an ankle is described below, but it is possible to have a configuration in which a plurality of units 5 is provided. In this case, the units 5 are preferably worn in locations that are at positions of higher depth than the wearing position of the dive computer 4 based on the state of descent in the order of ankle, chest, and head.

Figure 2:
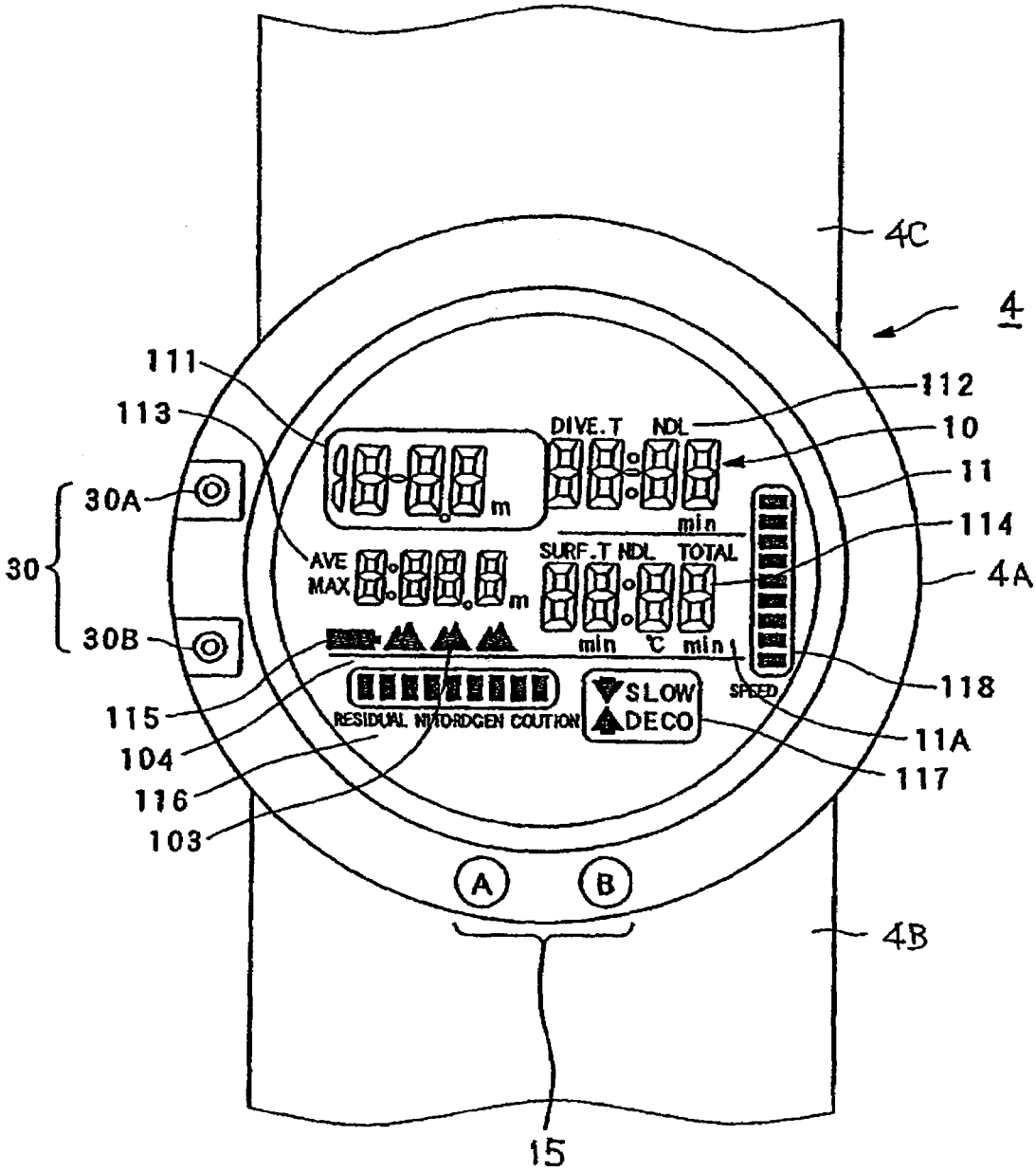
FIG. 2 is an external front view of a dive computer according to the embodiments.

FIG. 2 is an external front view of the dive computer. Also, FIG. 3 is a schematic block diagram of the dive computer. The dive computer 4 is configured to calculate and to display the dive time and the diver depth during diving, to measure the amount of inert gas (principally the amount of nitrogen gas) accumulated in the body during diving, and to display, based on the measurement results, the time or other type of safety-ensuring information until the nitrogen accumulated in the body can be purged once the diver has emerged from the water following diving.

The dive computer 4 is configured so that wristbands 4B and 4C are connected, respectively, to a discoid device main body 4A, allowing the dive computer to be mounted and worn on a user's arm with the aid of the wristbands 4B and 4C in the same way as a wristwatch.

The device main body 4A is secured by screw fastening or another method while the upper and lower cases are kept in a completely airtight state, and contains various electronic parts (not shown). A display unit 10 with a liquid crystal display panel 11 is disposed on the pictured front face of the device main body 4A.

Controls 15 to select/switch the operating modes in the dive computer 4 are further formed on the pictured bottom of the device main body 4A, and the controls 15 have two switches A and B shaped as pushbuttons. A diving operation monitoring switch 30 featuring a conduction sensor used to determine whether a dive has started is provided to the device main body 4A on the left-hand side of the diagram.

The diving operation monitoring switch 30 has electrodes 30A and 30B disposed on the pictured front face of the device main body 4A, and it is determined that immersion in water has started when the resistance between the electrodes 30A and 30B is reduced as a result of a conductive state being established between the electrodes 30A and 30B by seawater or the like. However, the diving operation monitoring switch 30 is used solely to detect immersion in water and to cause the operating mode of the dive computer 4 to switch to the diving mode, not to detect that an actual dive (descent in water) has started. A specific reason is that there may be cases in which the user's hand with the dive computer 4 is merely immersed in seawater, and it is undesirable under such conditions to conclude that a dive has started.

For this reason, it is assumed in the case of the present dive computer that a dive has started in the event that the water pressure (depth) registered by a pressure sensor inside the device main body 4A has reached or exceeded a certain level; specifically, the water pressure has reached or exceeded an equivalent of 1.5 m in terms of depth, and it is assumed that the dive has ended in the event that the water pressure is less than 1.5 m in terms of depth.

In broad terms, the dive computer 4 is composed of the controls 15 to perform control operations, the display unit 10 to display information, the diving operation monitoring switch 30, a sound alarm 37 to notify the user with a buzzer or other alarm, an oscillation generator 38 to notify the user through vibrations, an ultrasonic wave receiver unit 47 to receive ultrasonic communication signals from the external sensor unit 5, a demodulator circuit 48 to demodulate incoming ultrasonic communication signals, a control unit 50 to control the entire dive computer, a pressure gauge 61 to measure air or water pressure, a second temperature measuring unit 62 to measure temperature, and a timer 68 for various timing routines, as shown in FIG. 3.

The display unit 10 is composed of a liquid crystal display panel 11 to display various types of information, and a liquid crystal driver 12 to drive the liquid crystal display panel 11.

The control unit 50 has a CPU 51 that is designed to control the entire device and is connected to the switches A and B (controls 15), the diving operation monitoring switch 30, the sound alarm 37, and the oscillation generator 38; a control circuit 52 that is designed to control the liquid crystal driver 12 in order to form a display that corresponds to each operating mode on the liquid crystal display panel 11 under control from CPU 51, or is designed to perform processing in each of the operating modes in the time counter 33 described below; ROM 53 to store control programs and control data; and RAM 54 (water temperature recording unit) to store temporarily each type of data.

The pressure gauge 61 measures air pressure and water pressure because of the need to measure and to display depth (water pressure) in the dive computer 4 and to measure the amount of inert gas (principally the amount of nitrogen gas) accumulated in the user's body on the basis of depth and dive time. The pressure gauge 61 has a pressure sensor 34 made of a semiconductor pressure sensor, and also has an amplifier circuit 35 to amplify the output signal of the pressure sensor 34 to amplify the output signal of the pressure sensor 34, and an A/D converter circuit 36 to subject the output signal of the amplifier circuit 35 to an analog/digital conversion and to output the result to the control unit 50.

The second temperature measuring unit 62 is needed to measure temperature (water temperature) in the dive computer 4 and to measure the water temperature. The second temperature measuring unit 62 has a temperature sensor 63 made of a semiconductor temperature sensor, for example, an amplifier circuit 42 to amplify the output signal of the temperature sensor 63, and an A/D converter circuit 65 to subject the output signal of the amplifier circuit 64 to an analog/digital conversion and to output the result to the control unit 50.

The timer 68 is composed of a generator circuit 31 to output clock signals with a predetermined frequency in order to keep time in the regular manner or to monitor the dive time in the dive computer 4; a divider circuit 32 to divide the clock signals from the generator circuit 3l; and a time counter 33 to process time in one-second increments on the basis of the signal that is output by the divider circuit 32.

1.1 Ascent Velocity Monitoring Function

Figure 4:
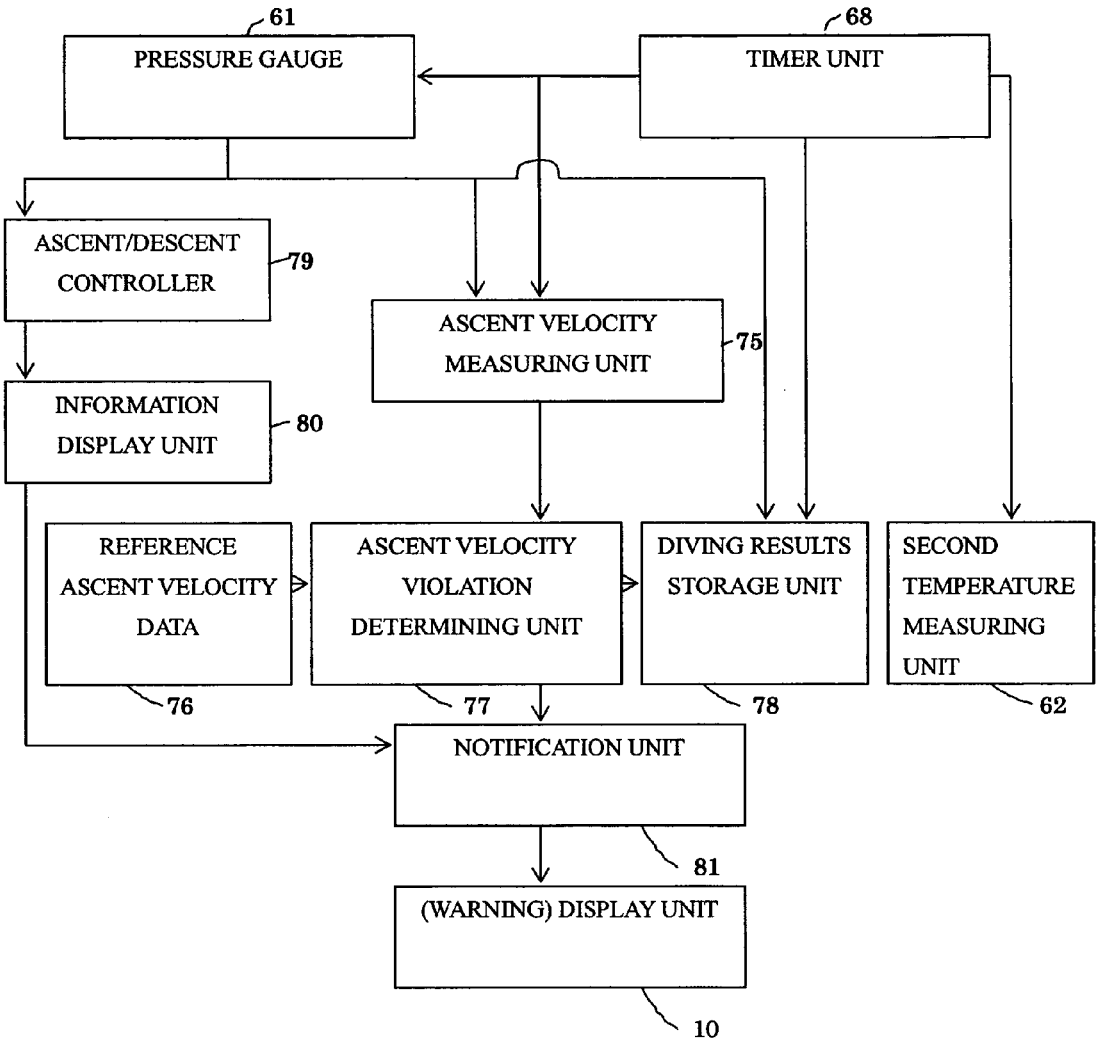
FIG. 4 is a functional block diagram for implementing the function of monitoring the ascent velocity.

FIG. 4 is a functional block diagram to implement the function of ascent velocity monitoring. The dive computer is configured to monitor the ascent velocity of the diver in the diving mode. This ascent/descent control function is implemented by way of the below-described configuration in which the functions of the MPU 51, ROM 53, RAM 54, and other components are used.

The dive computer, as shown in FIG. 4, has an ascent velocity measuring unit 75 to measure the ascent velocity during ascent on the basis of the timed results of the timer 68 and the measurement results of the pressure gauge 61; an ascent velocity violation determining unit 77 to compare the measurement results of the ascent velocity measuring unit 75 and the preset reference ascent velocity data 76, and to provide an ascent velocity violation warning when the current ascent velocity is higher than a reference ascent velocity that corresponds to current reference ascent velocity data 76; a diving results storage unit 78 to store diving history and other data related to diving; a second temperature measuring unit 62 to measure the water temperature in predetermined time intervals; an ascent controller 79 to monitor the ascent condition of the diver and to carry out control and other actions during warnings; an information display unit 80 to display various types of information; a notification unit 81 to provide warnings and other notifications; and a display unit 10 to display warnings.

More specifically, in the present embodiment, the ascent velocity violation determining unit 77 compares the current ascent velocity with the reference ascent velocity for each depth range stored in the ROM 53 as the reference ascent velocity data 76, and when the current ascent velocity is higher than the reference ascent velocity at the current depth, the notification device 13 generates an alarm sound, causes the display unit to blink, or produces another action, and transmits a vibration to the diver by way of the oscillation generator 14, or warns of an ascent velocity violation by another method. When the ascent velocity becomes equal to or less than the reference ascent velocity, the ascent velocity violation warning is stopped.

In the present embodiment, the following values are set as the reference ascent velocity data 76 for each depth range.

| Depth range | Reference ascent velocity value (upper limit value of ascent velocity) |
|---|---|
| Less than 1.8 m | Reference ascent velocity value → No warning |
| 1.8 m to 5.9 m | 8 m/minute (about 0.8 m/6 sec) |
| 6.0 m to 17.9 m | 12 m/minute (about 1.2 m/6 sec) |
| 18 m or more | 16 m/minute (about 1.6 m/6 sec) |

The reasons for setting the reference ascent velocity value to be larger at greater depths are that at great depths, it is possible to prevent adequately decompression sickness even if a relatively high ascent velocity is allowed because the water pressure ratio before and after ascending is low per unit of time at the same ascent velocity. At shallow depths, only a relatively low ascent velocity is allowed because the water pressure ratio before and after ascending is higher per unit of time at the same ascent velocity.

In the present embodiment, the ascent velocity value for every six seconds is stored in the ROM 53 as the reference ascent velocity data 76 in order to prevent the motion of the arm on which the dive computer is worn from affecting the calculated ascent velocity, even if the depth is measured every second. For the same reason, the ascent velocity is measured every six seconds. Therefore, the difference between the current depth measurement value and the previous depth measurement value of six seconds ago is calculated, and this difference is compared with the reference ascent velocity that corresponds to the reference ascent velocity data 76.

With the diving results storage unit 78 of the dive computer, the diving results data (diving time and date data, diving control number data, diving time data, maximum diving depth data, water temperature data at the maximum diving depth, and other data) from the moment the depth value measured by the pressure gauge 61 is greater than 1.5 m (depth value to determine the start of diving) until the moment the diving depth is once again less than 1.5 m are stored and held in the RAM 54 as data of a single diving operation. The diving results storage unit 78 performs the functions of the MPU 51, ROM 53, and RAM 54 shown in FIG. 2.

Here, the diving results storage unit 78 is configured to store as a diving result the fact that an ascent velocity violation occurred when a plurality of consecutive warnings was issued by the ascent velocity violation determining unit 77 during a single dive; for example, that two or more consecutive warnings were issued.

This diving results storage unit 78 measures the dive time on the basis of the measurement results of the timer 68 in the interval of time from the moment the depth value corresponding to the water pressure measured by the pressure gauge 61 is greater than 1.5 m (depth value to determine the start of diving) to the moment the depth is once again less than 1.5 m. If the measured dive time is less than three minutes, then this interval of time is not considered to be a single dive, and the diving results during that interval of time are not stored. This is because, from the aspect of storage capacity, there is a possibility that important diving records will be updated if an attempt is made to store all the diving data, including brief dives such skin dives.

Thus, in the dive computer 4 of the present embodiment, if the depth is 1.5 m or less and the dive time is 3 minutes or greater, it is concluded that a new dive has started, and the depth is considered to be 0 m so when the depth is less than 1.5 m after the start of diving. Therefore, if the depth is slightly greater than 1.5 m, there is a possibility that an ascent velocity violation warning will be issued when the depth of the dive computer alone becomes less than 1.5 m as a result of the arm being raised, despite the fact that the ascent speed is being maintained.

In view of the above, the present embodiment is configured so that an ascent velocity violation warning is not issued in such a case, and the reliability of the ascent velocity violation warning is improved.

[1.2] Functional Configuration when the Dive Computer Calculates the Nitrogen Amount Described next is a functional configuration in which the amount of nitrogen accumulated in the diver is calculated in the dive computer.

Figure 5:
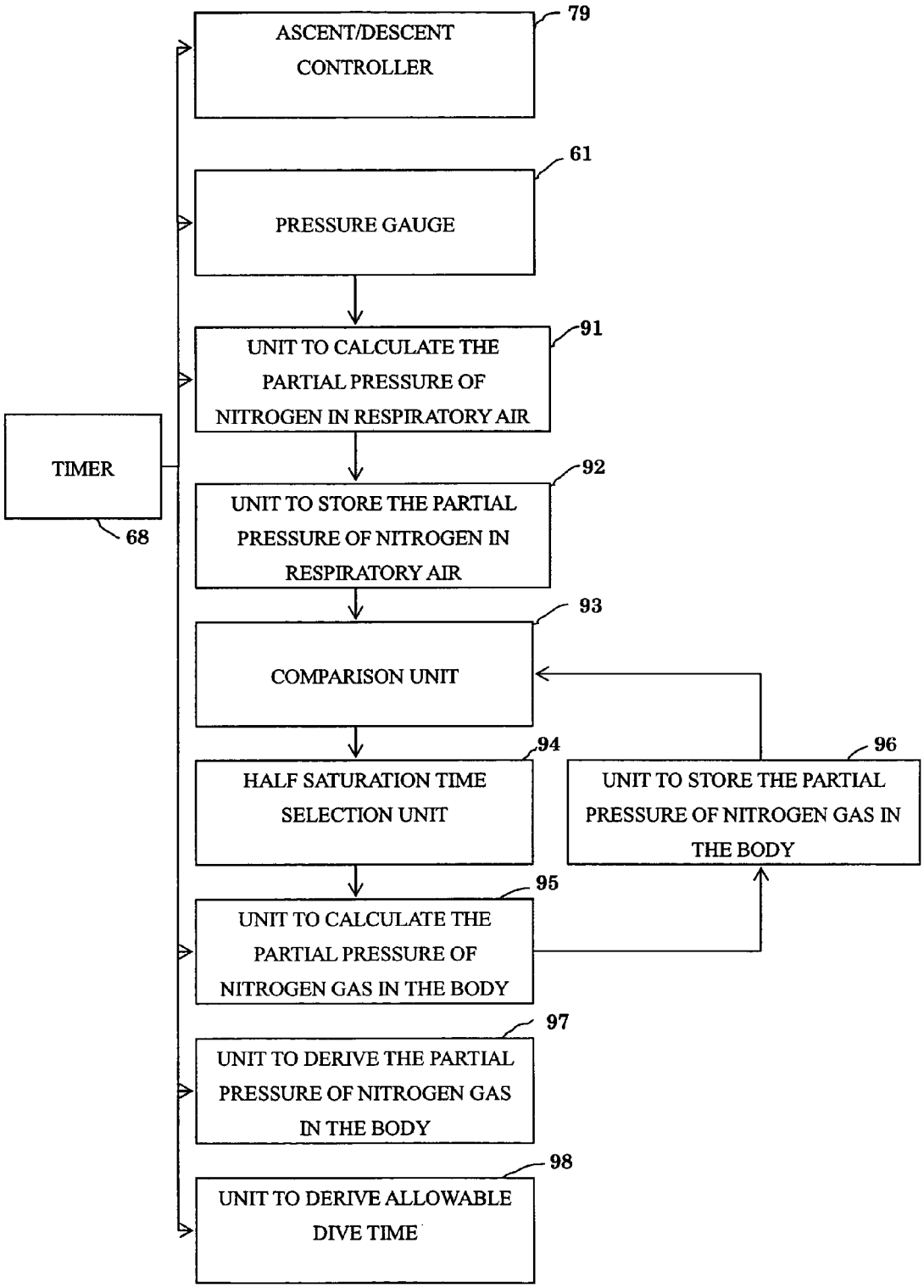
FIG. 5 is a functional block diagram to implement a function of calculating the amount of nitrogen in the body by the dive computer.

FIG. 5 is a functional block diagram to implement the function of calculating the amount of nitrogen in the body by the dive computer. As shown in FIG. 5, the dive computer, in addition to the above-described timer 68 and pressure gauge 61, has a unit to calculate the partial pressure of nitrogen in respiratory air 91, a unit to storing the partial pressure of nitrogen in respiratory air 92, a comparison unit 93, a half saturation time selection unit 94, a unit to calculate the partial pressure of nitrogen in the body 95, a unit to store the partial pressure of nitrogen in the body 96, a unit to derive the partial pressure of nitrogen in the body 97, and a unit to derive the allowable dive time 98. These may be implemented as software executed by the MPU 51, ROM 53, RAM 54, and constituent components shown in FIG. 2. However, this option is nonlimiting, and the above components may be implemented as logic circuits alone, which are hardware, or as a combination of software and processing circuits that include logic circuits and an MPU.

The unit to calculate the partial pressure of nitrogen in respiratory air 91 calculates the partial pressure of nitrogen in respiratory air PIN2(t), which is described hereinafter, on the basis of the water pressure P(t) at the current time t, which is the measurement result of the pressure gauge 61.

The unit to store the partial pressure of nitrogen in respiratory air 92 thereby stores the partial pressure of nitrogen in respiratory air PIN2(t) that was calculated by the unit to calculate the partial pressure of nitrogen in respiratory air 91.

The half saturation time selection unit 94 outputs the half saturation time TH that is used to calculate the partial pressure of nitrogen in the body to the unit to calculate the partial pressure of nitrogen in the body 95. The unit to calculate the partial pressure of nitrogen in the body 95 calculates the partial pressure of nitrogen in the body PGT(t), which is described hereinafter, for each tissue location in which the breathing/purging rate of nitrogen differs. The unit to store the partial pressure of nitrogen in the body 96 stores the partial pressure of nitrogen in the body PGT(t) that is calculated by the unit to calculate the partial pressure of nitrogen in the body 95. As a result, the comparison unit 93 compares the partial pressure of nitrogen in respiratory air PIN2(t) and the partial pressure of nitrogen in the body PGT(t), and varies the half saturation time TH on the basis of the comparison results.

[1.3] Method to Calculate the Partial Pressure of Nitrogen in the Body

Next, a specific method to calculate the partial pressure of nitrogen in the body will be described. The method to calculate the partial pressure of nitrogen in the body carried out in the dive computer 4 of the present embodiment is cited in "Dive Computers: A Consumer's Guide to History, Theory, and Performance" written by Ken Loyst, et al. (Watersport Publishing Inc., (1991)), and "Decompression-Decompression Sickness" written by A. A. Buhlmann (Springer, Berlin (1984)) (page 14 in particular), for example. The method of calculating the partial pressure of inert gas in the body shown here is no more than an example, and other methods may also be used. The pressure gauge 61 outputs the water pressure P(t) that corresponds to the time t. Here, P(t) refers to absolute pressure that includes atmospheric pressure.

The unit to calculate the partial pressure of nitrogen in respiratory air 91 calculates and outputs the partial pressure PIN2(t) of nitrogen in the respiratory air being breathed by the diver, on the basis of the water pressure P(t) outputted from the pressure gauge 61. Here, the partial pressure of nitrogen in respiratory air PIN2(t) is calculated with the aid of the following Eq. (1) by using the water pressure P(t).

$$PIN2(t)=0.79\times P(t)[\text{bar}] \tag{1}$$

The number "0.79" in Eq. (1) is the numerical value showing the ratio of nitrogen contained in air. The unit to store the partial pressure of nitrogen in respiratory air 92 stores the value of the partial pressure of nitrogen in respiratory air PIN2(t) that is calculated with the aid of the Eq. (1) by the unit to calculate the partial pressure of nitrogen in respiratory air 91.

The unit to calculate the partial pressure of nitrogen in the body 95 calculates the partial pressure of nitrogen in the body for each tissue location in the body in which the breathing/purging rate of nitrogen differs.

As an example of a particular tissue, the partial pressure of nitrogen in the body PGT(tE) that is breathed/purged in the dive period t=t0 to tE is calculated with the aid of the following Eq. (2), where PGT(t0) is the partial pressure of nitrogen in the body at the start of calculation (=t0).

$$\begin{aligned} PGT(tE) = PGT(t0) + & \\ & \{PIN2(t0) - PGT(t0)\} \times \\ & \{1 - \exp(-K(tE - t0)/HT)\} \end{aligned} \tag{2}$$

Here, K is a constant obtained through experimentation, and HT is the time (hereinafter referred to as half saturation time) required for the nitrogen to dissolve in the tissue and achieve a state of half saturation, and the numerical values are different for each tissue. This half saturation time HT, as will be described below, varies in accordance with the size of the PGT(t0) and PIN2(t0). Measurement of the time t0, the time tE, and other times is controlled by the timer 68 shown in FIG. 2.

The unit to calculate the partial pressure of nitrogen in the body 95 repeatedly calculates the partial pressure of nitrogen in the body PGT(t) as described above at a predetermined sampling cycle tE. The partial pressure of nitrogen in the body PGT(t) calculated with the aid of the above equation every sampling cycle, in addition to being supplied to the unit to derive the partial pressure of nitrogen in the body 97 and the unit to derive the allowable dive time 98, is also supplied as PGT(t0) to the comparison unit 93 and the unit to derive the partial pressure of nitrogen in the body 97 at this time. This means that the PGT(tE) at the previous time of sampling is used as the PGT(t0) in the equation.

Before the above-described calculation takes place, the comparison unit 93 compares the PGT(t0) supplied from the unit to store the partial pressure of nitrogen in the body 96 with the partial pressure of nitrogen in respiratory air PIN2(t0) stored in the unit to store the partial pressure of nitrogen in respiratory air 92, and the result of the comparison is output to the half saturation time selection unit 94. The half saturation time selection unit 94 stores the two types (half saturation times HT1 and HT2 described hereinafter) of half saturation time HT that should be used by the unit to calculate the partial pressure of nitrogen in the body 95 in the calculation of partial pressure, and the half saturation time HT1 or HT2 is selected in accordance with the comparison result obtained by the comparison unit 93, and is output to the unit to calculate the partial pressure of nitrogen in the body 95.

The unit to calculate the partial pressure of nitrogen in the body 95 calculates the partial pressure of nitrogen in the body PGT(tE) with the aid of the following equations using the half saturation time HT1 or HT2 selected by the half saturation time selection unit 94.

(A) In the case that PGT(t0)>PIN2(t0), $$PGT(tE)=PGT(t0)+\{PIN2(t0)-PGT(t0)\}\times\{1-\exp(-K(tE-t0)/HT1)\} \quad (3)$$

(B) In the case that PGT(t0)<PIN2(t0), $$PGT(tE)=PGT(t0)+\{PIN2(t0)-PGT(t0)\}\times\{1-\exp(-K(tE-t0)/HT2)\} \quad (3')$$

In the above-described Eqs. (3) and (3'), HT2<HT1. In the case that PGT(t0)=PIN2(t0), the half saturation time HT is preferably set as in the following equation.

$$HT=(HT1+HT2)/2 \quad (4)$$

The reasons that the half saturation time HT is different when PGT(t0)>PIN2(t0) and when PGT(t0)<PIN2(t0) are described below.

First, when PGT(t0)>PIN2(t0), nitrogen is being purged from the body, and when PGT(t0)<PIN2(t0), nitrogen is being absorbed by the body. That is to say, the half saturation time HT1 when purging nitrogen is set longer than the half saturation time HT2 when absorbing nitrogen because the purging of nitrogen requires more time in comparison with the absorption of nitrogen. By using a half saturation time HT that differs during purging and during absorption in this manner, the simulation of the amount of nitrogen in the body can be carried out with exactness. Therefore, on the basis of the nitrogen partial pressure that is computed by this virtual body nitrogen calculating unit 80, it is possible to calculate a more accurate value when computing the time during which non-decompression diving is possible and the time required to purge nitrogen from the body. The body nitrogen quantity calculating unit 60 allows the most recent partial pressure of nitrogen in the body to be obtained for the currently submerged diver by calculating the partial pressure of nitrogen in the body PGT(t) as described above.

[1.4] Method to Calculate the Time During which Non-decompression Diving is Possible and the Time Required to Purge Nitrogen from the Body The time during which non-decompression diving is possible and the time required to purge nitrogen from the body are calculated as follows on the basis of the partial pressure of nitrogen in the body PGT(tE) that was computed as described above, and on the basis of the partial pressure of nitrogen in respiratory air PIN2(tE) at time t=tE that was calculated by the unit to calculate the partial pressure of nitrogen in respiratory air 91. The time during which non-decompression diving is possible is calculated by computing (tE−t0) when the PGT(tE) calculated in the equation becomes Pto1, which indicates the amount of allowable oversaturation of nitrogen for each tissue. Here, since the current point in time is considered to be t0, the partial pressure of nitrogen in the body PGT(tE) that was computed by the unit to calculate partial pressure of nitrogen in the body 95 is used as the PGT(t0) in the equation; and the partial pressure of nitrogen in respiratory air PIN2(tE) that was previously calculated by the unit to calculate the partial pressure of nitrogen in respiratory air 62 is used as the PIN2(t0). In other words, $$tE-t0=-HT\times(1n(1-f))/K \quad (5)$$

In the formula, $$f=(Ptol-PGT(tE))/(PIN2(tE)-PGT(tE)).$$

The time during which non-decompression diving is possible is calculated for each type of tissue with the aid of this equation, and the lowest value among these is the computed time during which non-decompression diving is possible. The calculated time during which non-decompression diving is possible is displayed in the diving mode, as described hereinafter.

Next, the method to calculate the time required to purge nitrogen from the body after ascending to the surface will be described.

To calculate the time required to purge nitrogen from the body, tE for which PGT(tE)=0 should be computed, wherein t0 is the time of ascent to the surface in the above equation $$PGT(tE)=PGT(t0)+\{PIN2(t0)-PGT(t0)\}\times\{1-\exp(-K(tE-t0)/HT)\} \quad (6)$$

However, with an exponential function such as the above-described equation, PGT(tE) will not equal 0 if tE does not become infinite, so, for the sake of convenience, the body nitrogen purge time tZ is calculated for each tissue using the equation below.

$$tZ=-HT\times1n(1-f)/K \quad (7)$$

In the formula, $$f=(Pde-PIN2)/(0.79-PIN2).$$

Here, HT is the above-described half saturation time, and Pde is the nitrogen partial pressure (hereinafter referred to as the allowed partial pressure of nitrogen gas) to be used in the purging of the residual nitrogen gas from each tissue type, and both of these are known values. PIN2 is the nitrogen gas partial pressure within each tissue at the time of ascent to the surface, and it is calculated by the unit to calculate the quantity of nitrogen gas in the body 60. For each tissue type, tZ is calculated with the aid of the above-described equation, and the largest value among them is the time required to purge nitrogen gas from the body. The time required to purge nitrogen gas from the body that is calculated in this manner is displayed in a surface mode, which is described below.

[1.5] Operation

Described next is the operation of the dive computer with the above-described configuration.

Figure 6:
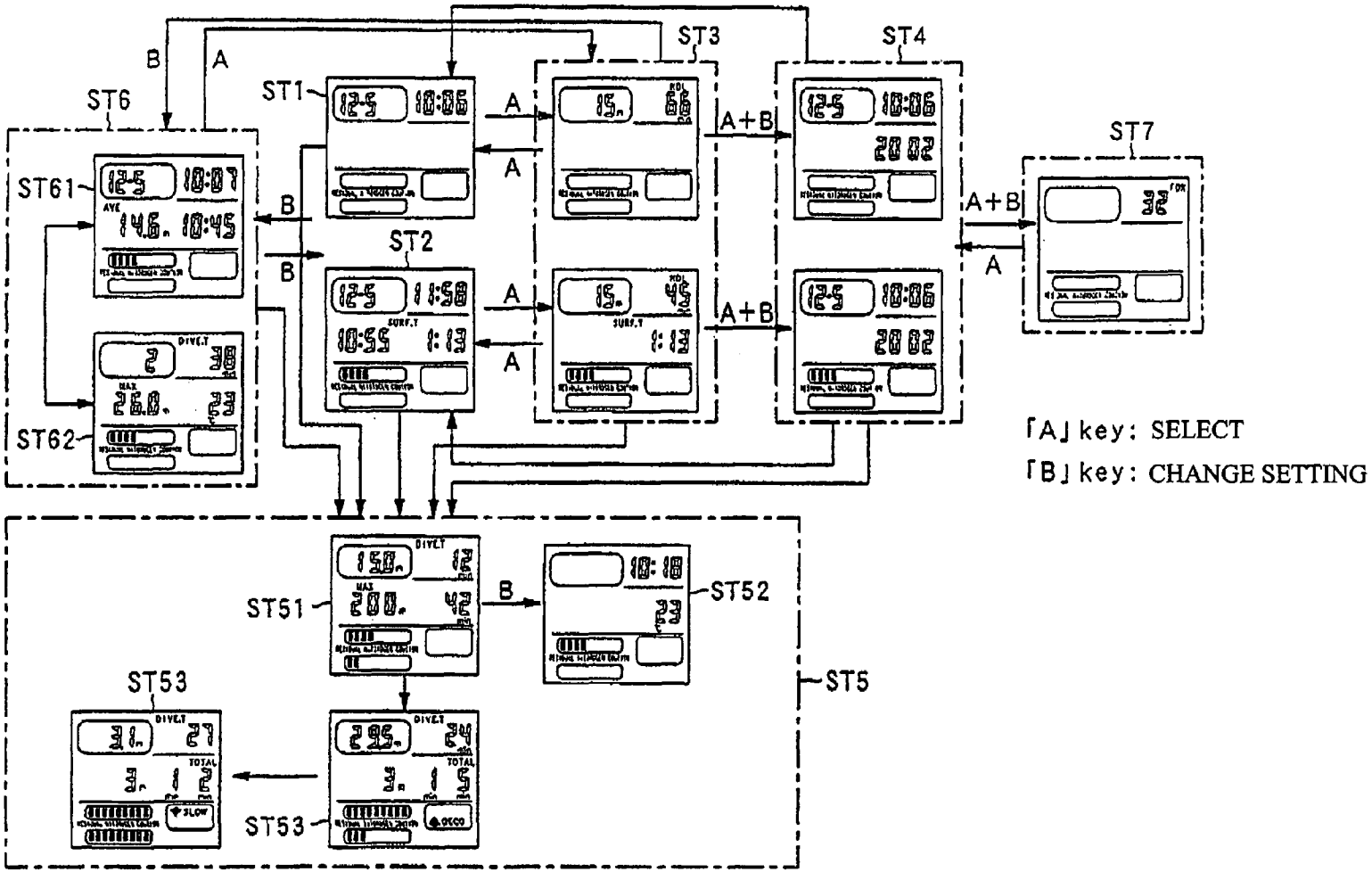
FIG. 6 is a diagram schematically depicting the manner in which a display screen changes its appearance in each of the operating modes of the dive computer.

FIG. 6 is a diagram schematically depicting the manner in which the display screen changes its appearance in each of the operating modes of the dive computer.

The dive computer 4 has the following operating modes: a time mode ST1, a surface mode ST2, a planning mode ST3, a setting mode ST4, a diving mode ST5, a log mode ST6, and an FO2 setting mode ST7, as shown in FIG. 6.

Before providing a description of each mode, the configuration of the display unit is described here with reference to FIG. 2.

The display surface 11A of the liquid crystal display panel 11 constituting the display unit 10 has eight display areas. The present embodiment is described with reference to an example in which the display surface 11A is shaped as a circle, but the circular shape is nonlimiting, and an elliptic shape, track shape, polygonal shape, or any other shape may also be used.

The first display area 111, which constitutes part of the display surface 11A is disposed on the upper left-hand side of the diagram, is configured to be the largest of the display areas, and is designed to display respectively the current depth, the current month and day, the depth rank, and the diving month and day (log number) in the diving mode, surface mode (time display mode), planning mode, and log mode.

The second display area 112 is disposed in the diagram to the right-hand side of the first display area 111 and is designed to display respectively the dive time, current time, the time during which diving without decompression is possible, and the dive start time (dive time) in the diving mode, surface mode (time display mode), planning mode, and log mode.

The third display area 113 is disposed in the diagram underneath the first display area 111 and is designed to display respectively the maximum depth, the time to purge nitrogen from the body, the safety level, and the maximum depth (mean depth) in the diving mode, surface mode (time display mode), planning mode, and log mode.

The fourth display area 114 is disposed in the diagram on the right-hand side of third display area 113 and is designed to display respectively the time during which diving without decompression is possible, the surface rest interval, the temperature, and the dive end time (water temperature at maximum depth) in the diving mode, surface mode (time display mode), planning mode, and log mode.

The fifth display area 115 is disposed in the diagram underneath the third display area 113 and is provided with a power supply capacity cutoff warning display unit 104 to display the power supply capacity cutoff, and an elevation rank display unit 103 to display the elevation rank corresponding to the current elevation of the user.

The sixth display area 116 is disposed in the diagram on the lower left-hand side of the display surface 11A and is designed to display the amount of nitrogen in the body in the form of a graph.

The seventh display area 117 is disposed in the diagram to the right of the sixth display area 116 and is composed of an area to indicate whether nitrogen gas (inert gas) tends to be absorbed or purged (shown as vertical arrows in the diagram) when a decompression diving state has been established in the diving mode; an area that displays "SLOW" to suggest slowing down as a warning about an ascent velocity violation when the acceptable ascent velocity is exceeded; and an area that displays "DECO" to warn that a decompression stop must be made during a dive.

The eighth display area 118 is disposed in the diagram on the right-hand side of the second display area 112 and the fourth display area 114 and is designed to display the ascent velocity in the form of a graph with nine segments. When the ascent velocity has exceeded the ascent velocity upper limit in the current depth range, all nine segments blink, notifying the diver of the fact that the ascent velocity upper limit in the current depth range has been exceeded.

All the operation modes are described next. The processing in each of these modes is performed by the control/computation unit 9 described above.

[1.5.1] Time Mode

The time mode ST1 does not perform a switching operation, but is a mode performed when the computer is carried on land in a state in which the nitrogen partial pressure inside the body is balanced. The current month and day, the current time, and the elevation rank are displayed on the liquid crystal display panel, as shown in FIG. 6 (refer to key symbol ST1). When the elevation rank is 0, no elevation rank is displayed. More specifically, the display in FIG. 6 signifies that the current month and day is December 5 and the current time is 10:06, and the user can know in particular that the currently displayed time is the current time by the blinking colon (:).

When the switch A in this time mode ST1 is pressed, the system shifts to the planning mode ST3. When the switch B is pressed, the system shifts to the log mode ST6. When the switch B is pressed continuously for a predetermined length of time (five seconds, for example), the system shifts to the setting mode ST4 while the switch A is being pressed.

[1.5.2] Surface Mode

The surface mode ST2 is a land-based mode that runs until 48 hours have elapsed since the previous diving. The dive computer 4 is adapted to shift automatically to the surface mode ST2 when the diving operation monitoring switch 30, which was in a conductive state during diving, enters a nonconductive state after the previous dive is completed. In addition to the current month and day, the current time, and the elevation rank being displayed in the time mode ST1, the time required to purge nitrogen from the body is displayed as a countdown in this surface mode ST2. When the time designed to be displayed as the time required for purging nitrogen from the body reaches 0 hours and 00 minutes, the system enters a non-display state. The time elapsed after the end of a dive is furthermore displayed as the surface rest interval in the surface mode ST2. This surface rest interval 202 is configured so that the clock is started as diving is deemed completed when the depth is shallower than 1.5 meters, and when 48 hours has elapsed after the completion of diving, the system enters a non-display state. Therefore, the dive computer 4 remains in this surface mode ST2 on land until 48 hours has elapsed after the completion of diving, and shifts to the time mode ST1 thereafter.

More specifically, the surface rest interval is 1 hour and 13 minutes in the surface mode ST2 shown in FIG. 6; that is, the fact that 1 hour and 13 minutes have elapsed since the completion of diving is displayed. The amount of nitrogen currently absorbed in the body as a result of diving is displayed as corresponding four lighted marks on the graph of nitrogen in the body, and the display shows the time that needs to elapse from the current condition until the excess nitrogen inside the body is purged and a balanced condition is achieved; in other words, the time required to purge nitrogen from the body is 10 hours and 55 minutes.

When the switch A is pressed in this surface mode ST2, the system shifts to the planning mode ST3, as shown in FIG. 6. When the switch B is pressed, the system shifts to the log mode ST6. The system shifts to the setting mode ST4 when the switch B is pressed continuously for a predetermined length of time (five seconds, for example) while the switch A is being pressed from the planning mode ST3.

[1.5.3] Planning Mode

The planning mode ST3 is an operating mode in which the approximate maximum depth and dive time for the next dive can be input before the dive. The depth rank, the time during which diving without decompression is possible, the surface rest interval, and the graph of nitrogen in the body are displayed in this planning mode ST3. The depth ranks are configured so that the display changes successively at predetermined time intervals. The depth ranks include, for example, 9 m, 12 m, 15 m, 18 m, 21 m, 24 m, 27 m, 30 m, 33 m, 36 m, 39 m, 42 m, 45 m and 48 m; and the display thereof is configured to refresh every five seconds. In the case that the system has shifted from the time mode ST1 to the planning mode ST3, and in the case that there is no excessive nitrogen accumulation in the body due to previous diving, in other words, since the system is in the planning mode for the first dive, the number of lighted marks displayed on the graph of nitrogen in the body is 0; more specifically, the time during which diving without decompression is possible is displayed as 66 minutes when the depth is 15 m, as shown in FIG. 6 (refer to key symbol ST3). This represents the fact that diving without decompression is possible for less than 66 minutes at a depth of 12 m or more and 15 m or less.

In contrast, if the system has shifted from the surface mode ST2 to the planning mode ST3, four lighted marks are displayed in the graph of inert gas in the body, and the time during which diving without decompression is possible is displayed as 45 minutes in the case that the depth is, for example, 15 m because planning is being carried out for repeated diving in which there is excessive accumulation of nitrogen in the body due to previous diving, as shown in FIG. 6. This represents the fact that diving without decompression is possible for less than 45 minutes at a depth of 12 m or more and 15 m or less.

In the interval of time that the depth rank is successively displayed from 9 m to 48 m in this planning mode ST3, the system will shift to the surface mode ST2, as shown in FIG. 6, when the switch A is pressed. The system automatically shifts to the time mode ST1 or the surface mode ST2 after the depth rank is displayed as 48 m. When the switches are not operated for a predetermined interval of time in this manner, the system automatically shifts to the time mode ST1 or the surface mode ST2, so it is convenient for the diver that there is no need to operate switches to reach these modes. When the switch B is pressed, the system shifts to the log mode ST6.

[1.5.4] Setting Mode

In addition to setting the current month and day, and the current time, the setting mode ST4 is an operating mode for setting the warning alarm ON/OFF and setting the safety level. The safety level (not depicted), the alarm ON/OFF (not depicted), and the elevation rank (not depicted) are displayed in addition to the current month and day, the current year, and the current time in this setting mode ST4. Of these display items, it is possible to select one of two safety levels: a level for carrying out normal decompression calculation, and a level for carrying out decompression calculation presuming that the diver moves to a location that is one rank higher in elevation after diving. In the case that excessive nitrogen has accumulated in the body from previous diving, the graph of nitrogen in the body is displayed. The alarm ON/OFF is a function for setting the option of sounding a warning alarm from a reporting device 13, and the alarm does not sound when the alarm is set to OFF. This is advantageous in devices in which battery power loss must be avoided to the greatest extent possible, as in an information processing device for a diver, because inadvertent battery power loss from the consumption of power by the alarm can be avoided. The alarm is turned ON when the ascent velocity is violated, during decompression diving, and in other critical diving situations.

The setting items consecutively change in the order of hour, second, minute, year, month, day, safety level, and alarm ON/OFF each time the switch A is pressed in the setting mode ST4, and the display of the area with the item to be set blinks. When the switch B is pressed at this time, the numerical value or the character changes, and when continuously pressed, the numerical values or the characters of the setting items change quickly. When the switch A is pressed when the alarm ON/OFF is blinking, the system returns to the time mode ST1 or the surface mode ST2. When the switches A and B are pressed simultaneously when the alarm ON/OFF is blinking, the system shifts to the FO2 setting mode ST7. If neither of the switches A and B is operated for a predetermined interval of time (1 to 2 minutes, for example), the system automatically returns to the time mode ST1 or the surface mode ST2.

[1.5.5] Diving Mode

The diving mode ST5 is an operation mode used during diving, and the mode includes a non-decompression diving mode ST51, a current time display mode ST52, and a decompression diving mode ST53.

The current depth, the dive time, the maximum depth, the time during which diving without decompression is possible, the graph of the nitrogen in the body, the elevation rank, and other information required in diving are displayed in the non-decompression diving mode ST51.

In the non-decompression diving mode ST51 shown in FIG. 6 in the above-described example, the display shows the fact that 12 minutes have elapsed since diving began, the diver is currently at a depth of 15.0 m, and diving without decompression can continue for another 42 minutes at this depth. Also displayed is the maximum depth until the current point in time, which is 20.0 m, and four lighted marks in the graph 203 showing the current amount of nitrogen in the body are lighted to show the level.

In the diving mode ST5, the ascent velocity monitoring function described above is used because a rapid ascent results in decompression sickness. That is to say, the current ascent velocity is calculated at every predetermined interval of time (every six seconds, for example); the calculated ascent velocity and the ascent velocity upper limit value corresponding to the current depth are compared; and in the case that the calculated ascent velocity is higher than the ascent velocity upper limit value, an alarm sound (ascent velocity violation warning alarm) is issued for three seconds at a frequency of 4 kHz from the sound alarm 13, and the ascent velocity violation warning is performed by alternately displaying the current depth and the warning "SLOW" on the liquid crystal display panel 11 with a predetermined cycle (a one second cycle, for example) to suggest that the ascent velocity be slowed. The diver is further warned of the ascent velocity violation by a vibration from the oscillation generator 38. The ascent velocity violation warnings stop once the ascent velocity decreases to a normal level.

When the switch B is pressed in the diving mode ST5, and while the switch A is continuously pressed, the system shifts to the current time display mode ST52, and the current time and current temperature are displayed. More specifically, displayed in the current time display mode ST52 shown in FIG. 6 is a current time of 10:18 and a current temperature of 23° C. Thus, when the switches are operated in the diving mode ST5, the current time and current temperature are displayed for a predetermined interval of time, so even if the system is configured to display normally and solely the data required in diving within a small display screen, it is convenient because the current time and other information can be displayed as needed. Because switch operation is used to switch between displays even in the diving mode ST5 in such a manner, the information desired by the diver can be displayed with reasonable timing.

In the diving mode ST5, when the diver has ascended to a depth that is shallower than 1.5 m, diving is deemed completed, and the system automatically shifts to the surface mode ST2 when the diving operation monitoring switch 30, which was in a conductive state during diving, enters a nonconductive state. The interval from the time at which the depth is 1.5 m or more to the time at which the depth is again less 1.5 m is defined as a single diving action, and the diving results (diving date, dive time, maximum depth, and other data) during this interval of time are stored in the RAM 54. In the case that two or more consecutive ascent velocity violation warnings described above are issued during a dive, this is also recorded in the diving results.

The dive computer of the present embodiment is configured under the assumption of non-decompression diving, but when decompression diving is required, the relevant alarm is turned on, the diver is informed, and the system shifts the operating mode to the decompression diving display mode ST53.

The current depth, dive time, graph of the nitrogen in the body, elevation rank, decompression stop depth, decompression stop time, and total ascent time are displayed in the decompression diving display mode ST53. More specifically, the fact that 24 minutes have elapsed since the start of the dive, and that the diver is at a depth of 29.5 m is displayed in the decompression diving display mode ST53 shown in FIG. 6. Further displayed are instructions that direct the diver to ascend to a depth of 3 m while maintaining a safe ascent velocity, and to carry out a decompression stop for one minute at that point, because the amount of nitrogen in the body has exceeded the maximum allowed value and the diver is in danger. The diver carries out a decompression stop based on the content of the display as described above, and ascends thereafter; and the fact that the amount of nitrogen in the body is decreasing is displayed by way of a downward-pointing arrow while decompression is being carried out.

[1.5.6] Log Mode

The log mode ST6 is a function to store and to display various data when diving continues for three minutes or more at a depth greater than 1.5 m in the diving mode ST5. Such diving data are consecutively stored for each dive as log data, and log data for a fixed number of dives (ten dives, for example) are stored and retained. Here, when the number of dives exceeds the maximum number of stored dives, the newer logs are stored by erasing data in order beginning with old data. Even when the maximum number of stored dives is exceeded, the system may be configured to protect a portion of the log data from being erased by way of a preselected setting.

It is possible to shift to this log mode ST6 by pressing switch B in the time mode ST1 or the surface mode ST2. The log mode ST6 has two mode screens in which the log data changes every prescribed interval of time (four seconds, for example). The diving month and day, mean depth, diving start time, diving end time, elevation rank, and graph of nitrogen in the body at the time the dive ended are displayed in the first log mode ST61, as shown in FIG. 6. The log number showing the dive number on the day that diving was carried out, maximum depth, dive time, water temperature at maximum depth, elevation rank, and graph of nitrogen in the body at the time the dive ended are displayed in the second log mode ST62. More specifically, the fact that on the second dive of December 5 with an elevation rank of 0 the dive started at 10:07 and ended at 10:45 for a dive of 38 minutes is displayed, as shown in FIG. 6 (refer to key symbol ST6). Also displayed for this dive is the fact that the mean depth is 14.6 m, the maximum depth is 26.0 m, the water temperature is 23° C. at the maximum depth, and an amount of nitrogen that corresponds to four lighted marks on the graph of nitrogen in the body has been absorbed.

Since various data can be displayed in this manner while automatically switching between two mode screens in the log mode ST6 of the present embodiment, the amount of data that can be displayed is substantially increased even if the display screen is small, and visibility is not reduced.

Data are displayed in order from new data to old data each time the switch B is pressed in the log mode ST6, and after the oldest log data are displayed, the system shifts to the time mode ST1 or the surface mode ST2. The system can be shifted to the time mode ST1 or the surface mode ST2 by pressing the switch B for two seconds or more, even in a state in which the display of a portion of the entire set of log data has ended. Even when either of the switches A and B has not been operated for a prescribed interval of time (1 to 2 minutes), the operating mode automatically returns to the surface mode ST2 or the time mode ST1. Therefore, the diver is not required to operate the switches, and convenience is improved. When the switch A is pressed, the system shifts to the planning mode ST3.

[1.5.7] FO2 Setting Mode

In the FO2 setting mode ST7, FO2 is caused to blink at 2 Hz, and the setting FO2 is enabled.

Simultaneously pressing switches A and B in the setting mode ST4 makes it possible to switch to the FO2 mode ST7.

In the FO2 mode ST7, pressing the switch A returns the system to the setting mode ST4, and pressing the switch B allows FO2 to be set.

When switch B is continuously pressed in this case, fast-forward display is carried out at 8 Hz, but in the case of a preset FO2 value such as 21% or 32%, the display is held unchanged until the next key input.

Next, the configuration of the external sensor unit is described.

Figure 7:
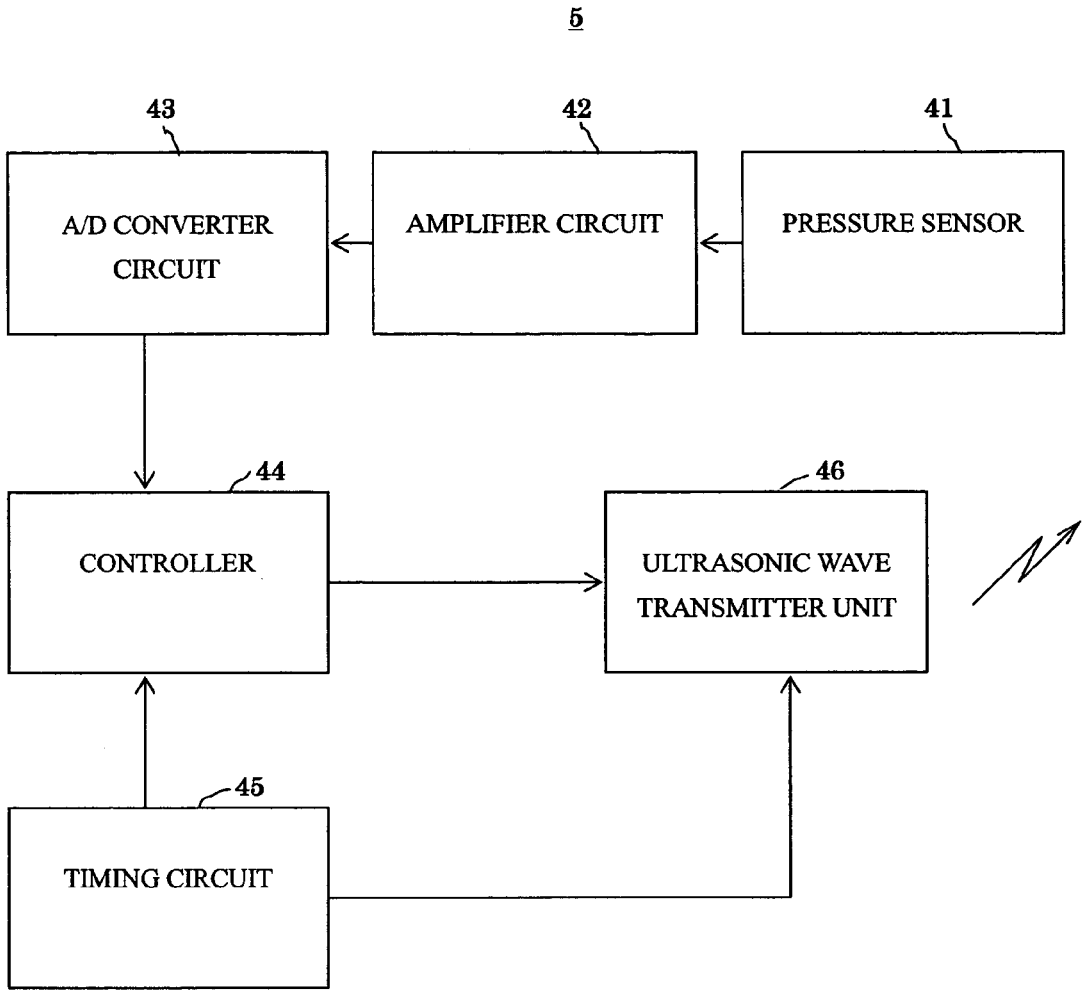
FIG. 7 is a schematic block diagram of an external sensor unit of the first embodiment.

FIG. 7 is a schematic block diagram of the external sensor unit 5.

The external sensor unit 5 has a pressure sensor 41 to detect pressure in the area around the wearing location and to output pressure detection signals; an amplifier circuit 42 to amplify the pressure detection signal and to output the result as an amplified pressure detection signal; an A/D converter circuit 43 to subject the amplified pressure detection signal to an analog/digital conversion and to output the result as pressure data; a controller 44 to control the entire external sensor unit 5 and to convert pressure data to a transmitter data format; a timing circuit 45 to generate respectively timing signals for pressure detection timing and pressure data transmission timing; and an ultrasonic wave transmitter unit 46 to transmit transmitter data to the dive computer 4 by ultrasonic waves on the basis of the pressure data transmission timing.

Next, the operation of the first embodiment is described.

First, the operation of the external sensor unit 5 is described.

The pressure sensor 41 detects the water pressure in the area around the wearing location (in the working example, in the area around the ankle) and outputs the result to the amplifier circuit 42. The amplifier circuit 42 amplifies the pressure detection signal and outputs the result to the A/D converter circuit 43 as an amplified pressure detection signal. The A/D converter circuit 43 subjects the amplified pressure detection signal to an analog/digital conversion and outputs the result to the controller 44.

The timing circuit 45 generates a timing signal corresponding to the pressure detection timing and outputs the result to the controller 44.

The controller 44 thereby converts the inputted pressure data to transmitter data format, and outputs the result to the ultrasonic wave transmitter unit 46.

The timing circuit 45 generates a timing signal corresponding to the pressure data transmission timing and outputs the result to the ultrasonic wave transmitter unit 46.

As a result, the ultrasonic wave transmitter unit 46 transmits transmitter data to the dive computer 4 by ultrasonic waves on the basis of the pressure data transmission timing.

Next, the principal operation of the first embodiment is described.

Figure 8:
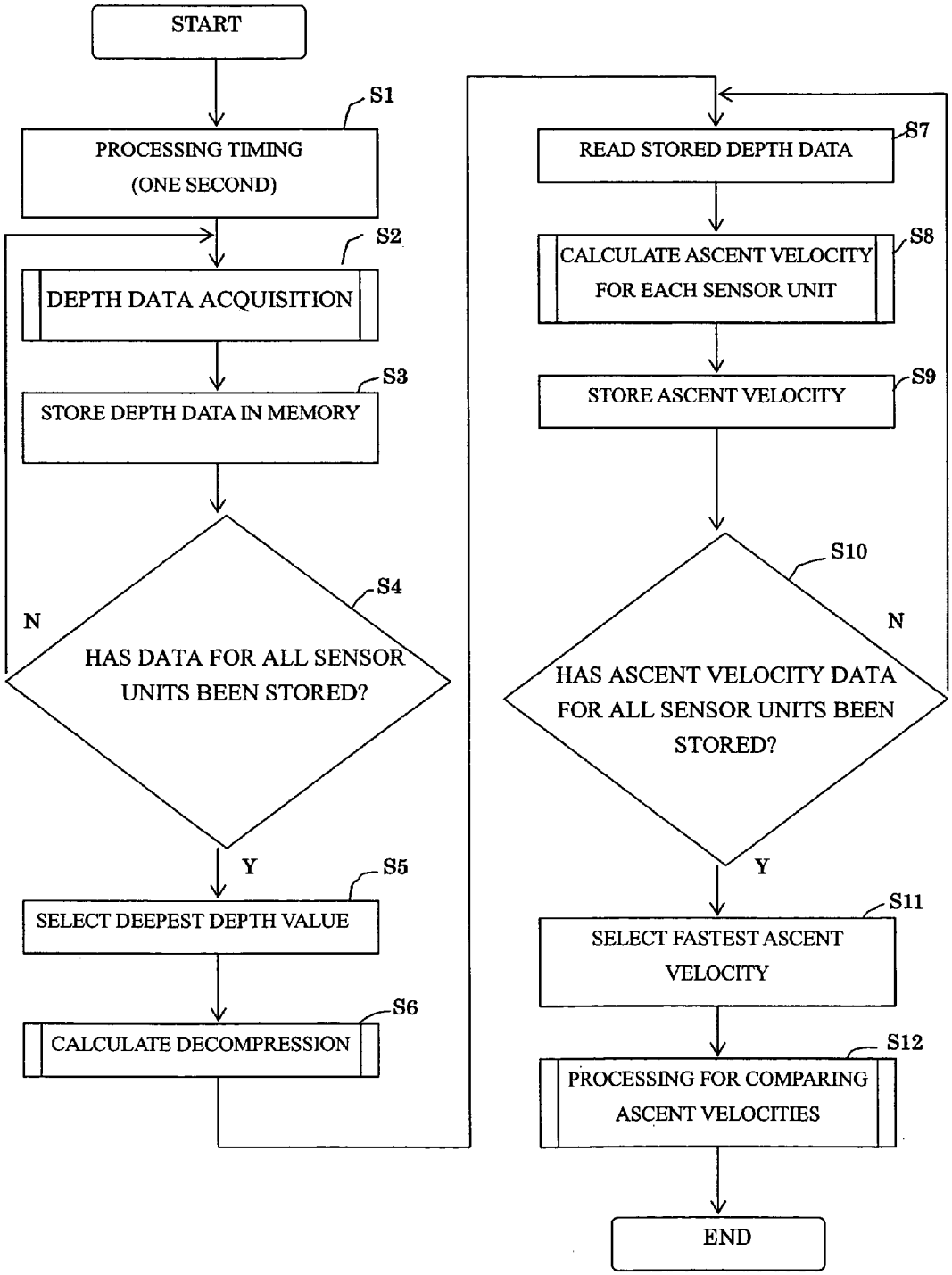
FIG. 8 is a processing flowchart of a dive computer of the first embodiment.

FIG. 8 is a processing flowchart of the dive computer of the first embodiment. In the present embodiment, a single external sensor unit 5 is provided, but the processing flowchart is capable of handling a plurality of external sensor units 5.

The control unit 50 receives transmitter data transmitted by external sensor units 5 with the ultrasonic wave receiver unit 47 when the processing timing at each predetermined time (one second in the present embodiment) has arrived (step S1), and demodulates the data with the demodulator circuit 48 to acquire the result as depth data. The dive computer itself acquires depth data (step S2) by way of the pressure gauge 61.

The controller 50 subsequently stores (step S3) the acquired plurality of depth data in memory (RAM 54).

Next, the control unit 50 determines whether the depth data from all external sensor units 5 have been stored in memory (step S4).

In the determination of step S4, the control unit 50 returns the processing to step S2 in the case that the depth data from all of the external sensor units 5 have not yet been stored in memory (step S4: NO), and thereafter carries out the processing in steps S2 to S4.

In the determination of step S4, the control unit 50 selects (step S5) the depth data of the deepest depth from among the depth data stored in the memory when the depth data from all of the external sensor units 5 have been stored in memory (step S4: YES).

The control unit 50 subsequently calculates decompression with the above-described method from the depth corresponding to the depth data selected in step S5, and calculates the time during which non-decompression diving is possible (step S6).

Next, the control unit 50 reads the depth data stored in memory (step S7), and the ascent velocity is calculated for each external sensor unit 5 to obtain the ascent velocity data (step S8).

The control unit 50 stores the ascent velocity data of each external sensor unit 5 obtained in step S8 in memory (step S9).

Next, the control unit 50 determines whether the ascent velocity data corresponding to all external sensor units 5 have been stored in memory (step S10).

In the determination of step S10, the control unit 50 returns the processing to step S7 in the case that the ascent velocity data from all of the external sensor units 5 have not yet been stored in memory (step S10: NO), and thereafter carries out the processing in steps S7 to S10.

In the determination of step S10, the control unit 50 selects (step S11) the depth data of the deepest depth from among the depth data stored in the memory when the depth data from all of the external sensor units 5 have been stored in memory (step S10: YES).

Next, the controller 50 carries out an ascent velocity comparison routine, and provides a warning of an ascent velocity violation when required (step S12).

Specifically, the control unit 50 compares the current ascent velocity acquired in step S11 with the reference ascent velocity data 76 (ascent velocity upper limit value) for each depth range stored in the ROM 53; displays on the liquid crystal display panel 11 with a display unit 10 the fact that the current ascent velocity is faster than the reference ascent velocity data 76 (ascent velocity upper limit value) corresponding to the current depth; and issues a warning of an ascent velocity violation by notification (generates an alarm sound from the sound alarm 37, transmits vibrations to the diver from the vibration generator 38, or issues a warning by another method) with the notification unit 81. The controller 50 furthermore stops the warning of the ascent velocity violation when the ascent velocity returns to a slower state than the ascent velocity upper limit value.

More specifically, the values shown below for each depth range are set as the ascent velocity upper limit values.

| Current measured depth values | Upper limit values of the ascent velocity |
|---|---|
| Less than 1.8 m | No warning |
| 1.8 m to 5.9 m | 8 m/minute (about 0.8 m/6 sec) |
| 6.0 m to 17.9 m | 12 m/minute (about 1.2 m/6 sec) |
| 18 m or more | 16 m/minute (about 1.6 m/6 sec) |

At a great depth, in other words, the water pressure ratio before and after ascent per unit of time is low even if ascent is carried out at the same ascent velocity, so decompression sickness can be adequately prevented even if a comparatively considerable ascent velocity is allowed. At a shallow depth, the water pressure ratio before and after ascent per unit of time is high even if ascent is carried out at the same ascent velocity, and only a comparatively slow ascent velocity is therefore allowed.

In this case, it is also possible for the diver to input the individual conditions (age, blood pressure, and other individual conditions) so as to bring the determination of the ascent velocity into conformity with the diver's own requirements.

[1.6] Modified Examples of the First Embodiment

[1.6.1] First Modified Example

In the description of the first embodiment above, the case in which depth data is used as the environment information data was considered, but it is also possible to have a configuration in which the water temperature data corresponding to the ambient water temperature is used. In such a case, a decompression algorithm should be applied using a low water temperature value in locations in which a temperature difference is generated, as in the case of a thermocline in the water.

In this case, when the reference ascent velocity (corresponding to the ascent velocity upper limit value described above) at which a warning is issued for the ascent velocity violation described above and the time during which non-decompression diving is possible are used in relation to the reference velocity that allows the diver to safely ascend, correction is not made when the surrounding temperature of the diver is within the standard temperature range (water temperature: 15.1° C. to 25° C.), but when the surrounding temperature of the diver is not within the standard temperature range, the reference ascent velocity and the time during which decompression diving is possible is corrected.

FIG. 9 is an example of the compensation coefficient table derived from the surrounding water.

The compensation coefficient table is stored in the ROM 53 in advance, and correction coefficients are stored for each temperature range.

In other words, the corrected reference ascent velocity and the corrected time during which decompression diving is possible are calculated by multiplying the reference ascent velocity and the time during which decompression diving is possible with a correction coefficient.

Specifically, when the water temperature around the diver measured with the second temperature measuring unit 62 is −5 to 5° C., the values obtained by multiplying the reference ascent velocity and the time during which decompression diving is possible by the correction coefficient 0.8 are taken as the corrected reference ascent velocity and the corrected time during which decompression diving is possible, and a determination is made.

Similarly, when the water temperature around the diver measured with the second temperature measuring unit 62 is 5.1 to 15° C., the values obtained by multiplying the reference ascent velocity and the time during which decompression diving is possible in the standard temperature range by the correction coefficient 0.9 are taken as the corrected reference ascent velocity and the corrected time during which decompression diving is possible, and a determination is made.

When the water temperature around the diver measured with the second temperature measuring unit 62 is 15.1 to 25° C., values resulting from multiplication by the correction coefficient 1 are taken as the corrected reference ascent velocity and the corrected time during which decompression diving is possible, so this is equivalent to the case in which no correction is made.

When the water temperature around the diver measured with the second temperature measuring unit 62 is furthermore 25.1° C. or higher, the values obtained by multiplying the reference ascent velocity and the time during which decompression diving is possible in the standard temperature range by the correction coefficient 0.9 are taken as the corrected reference ascent velocity and the corrected time during which decompression diving is possible, and a determination is made.

Therefore, when a temperature outside the standard temperature range has been detected, an ascent velocity violation warning is issued, control for shortening the dive time is carried out, information is displayed, and other actions are performed if more time is not taken for the ascent when using the corrected reference ascent velocity and the corrected time during which decompression diving is possible.

Furthermore, when a plurality of water temperatures has been obtained, the decompression algorithm is applied using the lowest value. Therefore, a correction coefficient of 0.9 is used when the temperature measured with the dive computer 4 worn on the wrist is 25° C., a temperature sensor is provided to the external sensor unit 5 worn on the ankle, and the temperature measured thereby is 25.1° C. A correction coefficient of 0.9 is also used when the temperature measured by the dive computer 4 is 15.1° C. and the temperature of the external sensor unit 5 is 15° C. A correction coefficient of 0.8 is used when the temperature measured by the dive computer 4 is 5.1° C. and the temperature of the external sensor unit 5 is 5° C.

It is also possible to have a configuration in which body temperature data corresponding to the body temperature of the diver are used instead of the ambient water temperature.

In the description above, wireless communication with ultrasonic waves was used to transmit environment information data, but it is also possible to have a configuration in which wireless communication is carried out using light, or in which wired communication is used.

[1.6.2] Second Modified Example

In the above description, the configuration was designed to generate and output safety-ensuring information that provides maximum safety from among the types of safety-ensuring information that are expected to be obtained for each wearing location, but also possible is a configuration in which a plurality of wearing locations are divided into a plurality of groups, and safety-ensuring information that provides maximum safety from among the types of safety-ensuring information that is expected to be obtained for each group is generated and output. Reliability is thereby improved.

[1.6.3] Third Modified Example

In the above description, a dive computer is described as an example of the device, but also possible is an aspect composed of a control method of the dive computer, the control program of the dive computer, and a computer-readable recording medium on which the control program is recorded.

As a specific aspect, the dive computer control method should be configured with an environment information measuring step to measure the environment information around a plurality of measured target locations, and a safety-ensuring information generating step to generate safety-ensuring information to ensure the safety of the diver on the basis of a plurality of types of environment information.

In this case, the safety-ensuring information generating unit should be configured to generate safety-ensuring information that provides maximum safety from among the types of safety-ensuring information that are expected to be obtained for each wearing location or for each group obtained by dividing a plurality of wearing locations into a plurality of groups.

Also, in the control program to control the information processing device for a diver with a computer, the configuration may be designed to measure the environment information around the plurality of measured target locations, and generate safety-ensuring information to ensure the safety of the diver on the basis of a plurality of types of environment information.

In this case, there is generated safety-ensuring information that provides maximum safety from among the types of safety-ensuring information that are expected to be obtained for each wearing location or for each group obtained by dividing a plurality of wearing locations into a plurality of groups.

It is also possible to record the control programs on a computer-readable recording medium.

[2] Second Embodiment

Next, a second embodiment is described with reference to the diagrams.

As described in the first embodiment, the dive computer and diving equipment calculate the required information to ensure the safety of the diver with a predetermined algorithm in the diving mode (in water), such as the current depth value, or the time or safe ascent velocity until inert gas excessively accumulated in the body is purged. The results are displayed on a liquid crystal display panel or other display. Not only is real time data displayed, but various information is also recorded to a log or profile (diving history) that retains information that is useful for later dives.

In this case, water temperature is one type of information that is recorded to the log or profile (diving history).

Conventionally, the water temperature kept in the log is one at the lowest water temperature or at the maximum depth. The reason that the lowest temperature is stored in memory is that, by being aware of the lowest temperature on the day (season) in which diving was performed, information is provided that is used to determine what diving form (wet suit, dry suit, or other equipment) should be used during the next dive.

However, in a configuration in which the water temperature at the maximum depth is also recorded, there is a possibility that, using summer or winter as an example in which the difference between the ambient air temperature and the water temperature is increased, the temperature measurement value would be recorded as the temperature in a state in which the water temperature measuring sensor is not yet acclimated to the water temperature in cases in which the ambient temperature is higher than the water temperature (in the case of summer) and the diver dives immediately to reach the maximum depth without moving to a new maximum depth thereafter.

Also, in a configuration in which the lowest water temperature is stored, the ambient air temperature is recorded as water temperature at the start of diving in a winter season, when the ambient air temperature is lower than the water temperature. Specifically, when the ambient air temperature is 5° C. and the water temperature 15° C., a water temperature of 5° C., which is the ambient air temperature, is recorded as the lowest temperature, and water temperature information that is different from sensed temperature is recorded in the log.

In view of the above, an object of the second embodiment is to provide a dive computer that can more accurately record log information or profile information in relation to water temperature.

Described first is the configuration of the external sensor unit used in the second embodiment instead of the external sensor unit 5 of the first embodiment.

Figure 10:
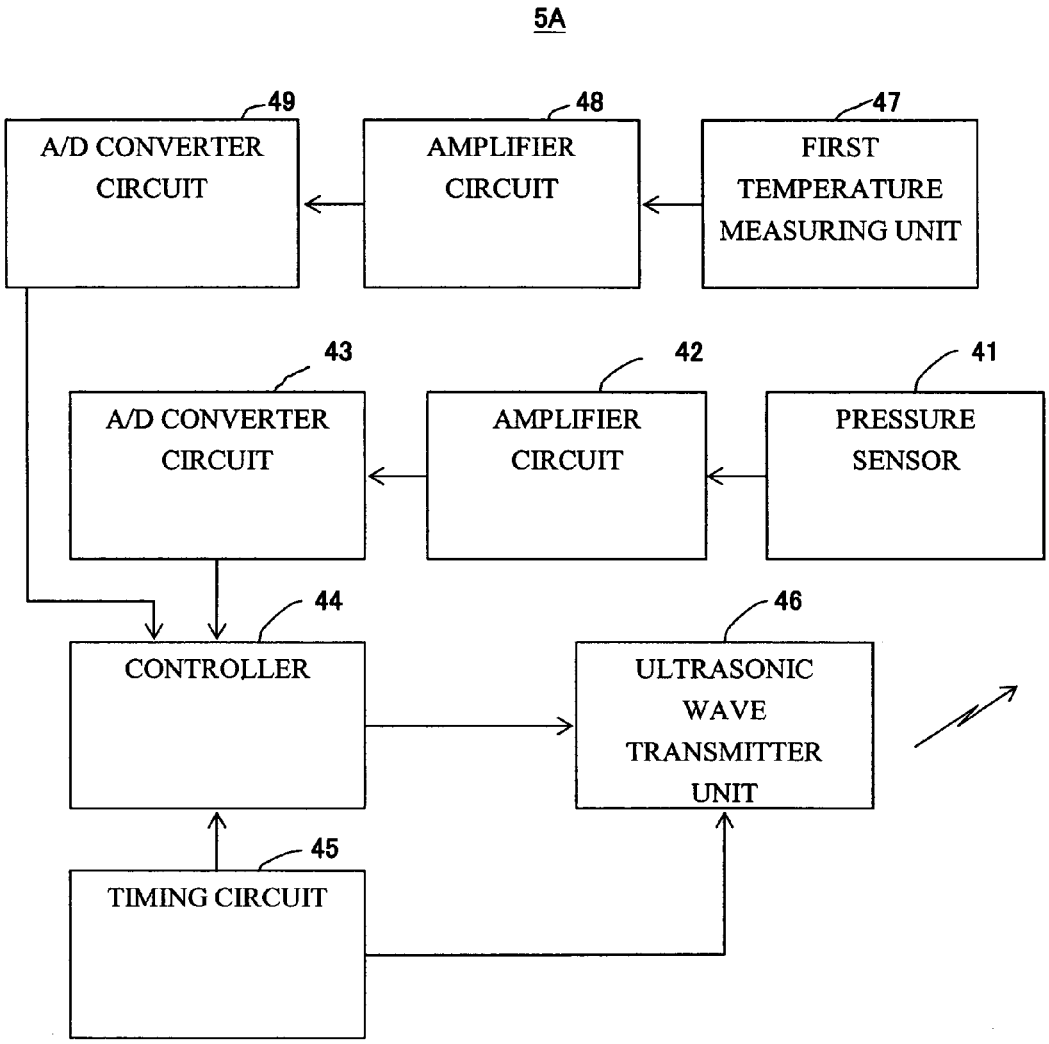
FIG. 10 is a schematic block diagram of an external sensor unit of the second embodiment.

FIG. 10 is a schematic block diagram of an external sensor unit 5A.

The external sensor unit 5A has a pressure sensor 41 to detect pressure in the area around the wearing location and to output pressure detection signals; an amplifier circuit 42 to amplify the pressure detection signal and to output the result as an amplified pressure detection signal; an A/D converter circuit 43 to subject the amplified pressure detection signal to an analog/digital conversion and to output the result respectively as pressure data; a controller 44 to control the entire external sensor unit 5 and to convert pressure data and temperature data described below to a transmitter data format; a timing circuit 45 to generate timing signals for pressure detection timing, temperature detection timing, pressure data transmission timing, and temperature data transmission timing; an ultrasonic wave transmitter unit 46 to transmit transmitter data to the dive computer 4 by ultrasonic waves on the basis of the pressure data transmission timing and the temperature data transmission timing; a first temperature measuring unit 47 to detect the temperature in the area around the wearing location and to output temperature detection signals; an amplifier circuit 48 to amplify the temperature detection signal and to output the result as an amplified temperature detection signal; and an A/D converter circuit 49 to subject the amplified temperature detection signal to an analog/digital conversion and to output the result as temperature data.

Described Next is the Operation of the Second Embodiment.

Except for the routines for recording the water temperature in the diving mode, the operation of the second embodiment is substantially the same as the first embodiment, so the routines for recording the water temperature information in the diving mode are described.

[2.1] Water Temperature Recording Routines

A knowledge of the lowest temperature on the day (season) in which diving was performed allows the water temperature information to be used to determine what diving form (wet suit, dry suit, or other equipment) should be used during the next dive, and the information is required information in the form of a log or profile.

Consideration must be given to the method by which processing is performed in the water temperature recording routine in order to record accurately the water temperature. Water temperature recording routines in the diving mode are described in detail below

[2.1.1] First Water Temperature Recording Routine

Described first as a water temperature recording routine is the case in which the first water temperature recording routine is carried out to record progressively a log while updating the water temperature in the RAM 54 until a preset acclimation time has elapsed in a manner such that the temperature sensor 63 of the second temperature measuring unit 62 or the first temperature measuring unit 47 of the external sensor unit 5A has stabilized and the temperature can be measured, and to record the lowest water temperature as a log after the acclimation time has elapsed.

Figure 11:
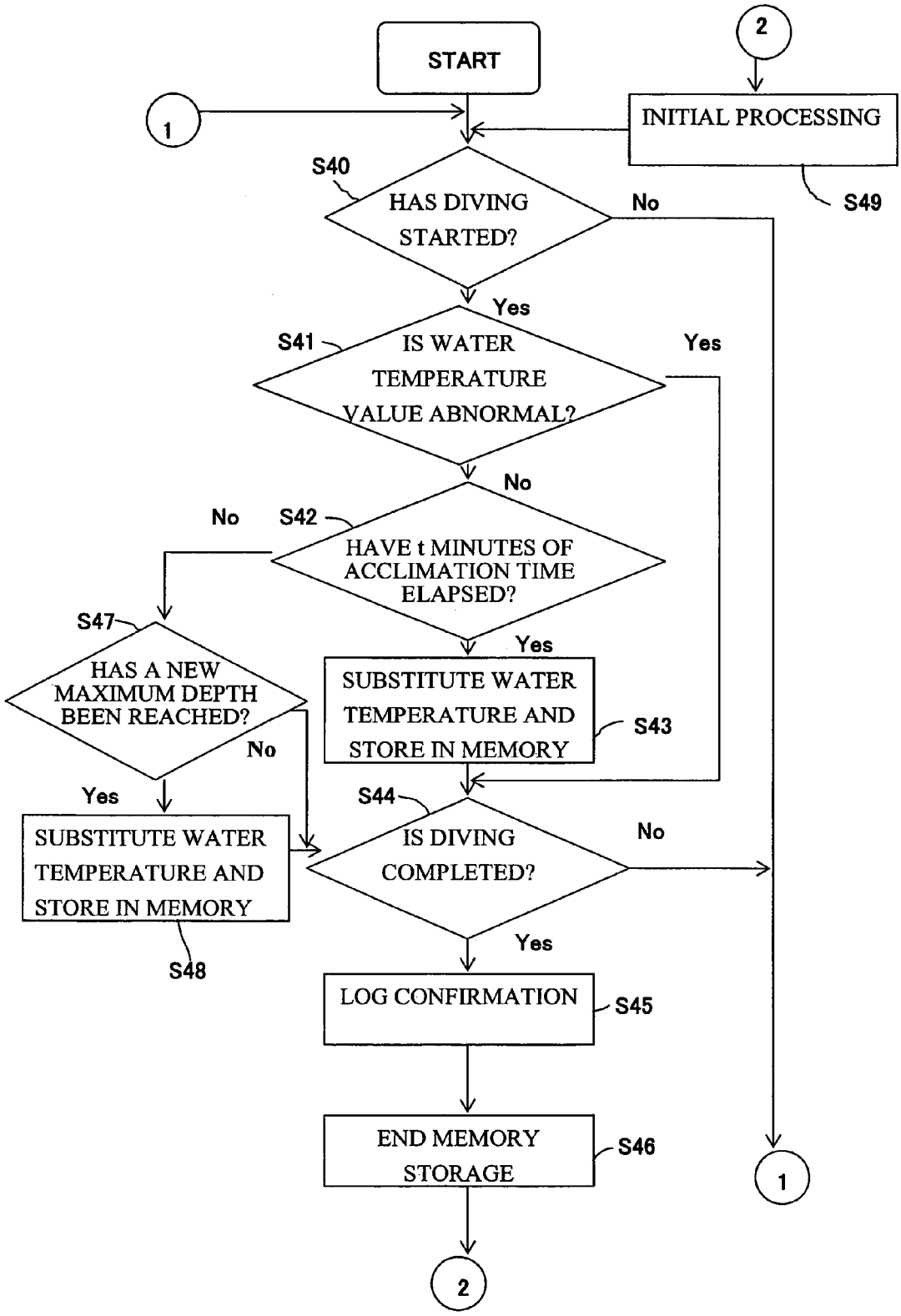
FIG. 11 is a processing flowchart of a first water temperature recording routine.

FIG. 11 is a processing flowchart of the first water temperature recording routine.

First, the MPU 51 determines whether the dive has started on the basis of the output signal of the diving operation monitoring switch 12 (step S40).

The MPU 51 enters a standby state if it has been determined in step S40 that the dive has not started.

If the dive has started in the determination of step S40, the MPU 51 determines (step S41), based on the output signal of the second temperature measuring unit 62, whether there are any abnormalities in the value of the water temperature that correspond to the temperature data transmitted from the external sensor unit 5A or in the value of the water temperature measured with the temperature sensor 63.

If, in the determination of step S41, there is an abnormality in the value of the water temperature that corresponds to the temperature data transmitted from the external sensor unit 5A or in the value of the water temperature measured with the temperature sensor 63, the MPU 51 advances to the processing of step S44 described below.

If, in the determination of step S41, there is no abnormality in the value of the water temperature that corresponds to the temperature data transmitted from the external sensor unit 5A and in the value of the water temperature measured by the temperature sensor 63; in other words, if normal results are obtained for the value of the water temperature that correspond to the temperature data transmitted from the external sensor unit 5A and/or the value of the water temperature measured by the temperature sensor 63, it is determined (step S42) that a preset acclimation time has elapsed for the temperature sensor 63 and the first temperature measuring unit 47.

The acclimation time required to reach a stable state varies with the component structure, and can therefore be set (varied) for each component.

If, in the determination of step S42, the acclimation time of the temperature sensor 63 and the first temperature measuring unit 47 has not yet elapsed, the MPU 51 overwrites in the RAM 54 the value of the water temperature measured with the temperature sensor 63 and the value of the water temperature that correspond to the temperature data transmitted from the external sensor unit 5A; in other words, the value of the water temperature recording area of the RAM 54 is updated with the measured value of the water temperature (step S43).

If, in the determination of step S42, the acclimation times have elapsed, the MPU 51 determines whether a new maximum depth has been reached (step S47) based on whether the temperature measured by the temperature sensor 63 and the first temperature measuring unit 47 have reached an equilibrium, and whether the temperature at the maximum depth is the measured temperature to be stored in the RAM 54.

If a new maximum depth has been reached in the determination of step S47, the MPU 51 overwrites the stored value of the water temperature measured by the temperature sensor 63 and the first temperature measuring unit 47 at the time the new maximum depth is reached; in other words, the stored value is updated (step S43) with the value of the water temperature measured at the point at which the new maximum depth has been reached, and the processing shifts to step S44.

If a new maximum depth has not been reached in the determination of step S47, the MPU 51 determines whether diving has ended (step S44).

If diving has not ended in the determination of step S44, the MPU 51 once again shifts the processing to step S40 and performs the same processing thereafter.

If diving has ended in the determination of step S44, the MPU 51 carries out processing to confirm (step S45) the diving log information (diving history), and the processing to store information in the RAM 54 is ended (step S46).

In accordance with the first water temperature recording routine as described above, the water temperature to be recorded as log information is successively updated with the actual measurement temperature until the acclimation time of the temperature sensor 63 and the first temperature measuring unit 47 has elapsed, and after the acclimation time has elapsed, the water temperature at the maximum depth (essentially corresponding to the lowest temperature) is recorded, so the log information related to water temperature can be made more accurate.

[2.1.2] Second Water Temperature Recording Routine

Described next as a water temperature recording routine is the case in which the second water temperature recording routine is carried out to record progressively a log while updating the water temperature in the RAM 54 when a normal water temperature value can be measured, and not to record a log until the temperature sensor 63 of the second temperature measuring unit 62 or the first temperature measuring unit 47 of the external sensor unit 5A has stabilized and the temperature can be measured; in other words, if it has been determined that the water temperature value is abnormal.

Figure 12:
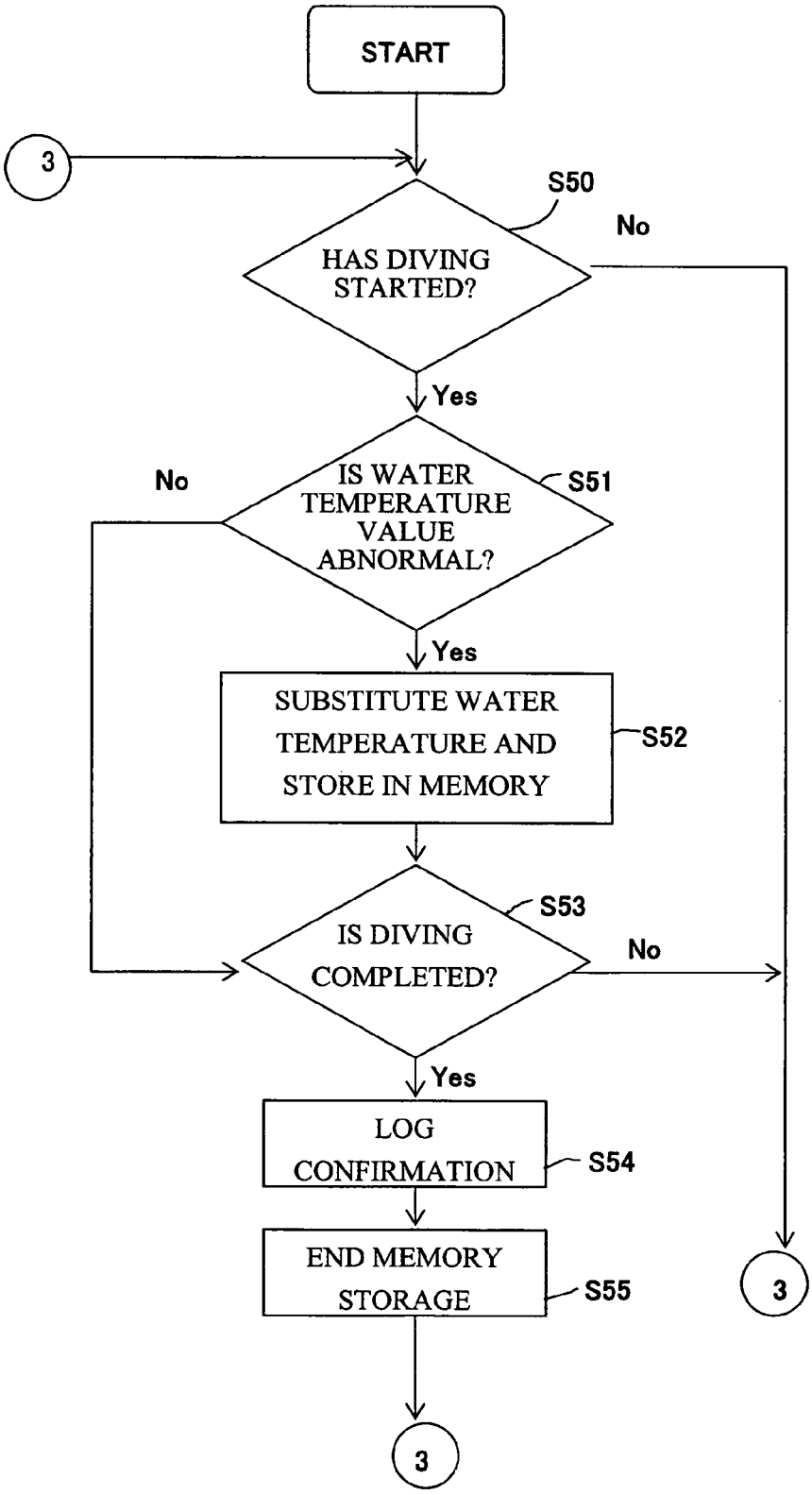
FIG. 12 is a processing flowchart of a second water temperature recording routine.

FIG. 12 is a processing flowchart of the second water temperature recording routine.

First, the MPU 51 determines whether the dive has started on the basis of the output signal of the diving operation monitoring switch 12 (step S50).

The MPU 51 enters a standby state if it has been determined in step S50 that the dive has not started.

If the dive has started in the determination of step S50, the MPU 51 determines (step S51) whether there is an abnormality in the value of the water temperature that corresponds to the temperature data transmitted from the external sensor unit 5A or in the value of the water temperature measured with the temperature sensor 63 of the second temperature measuring unit 62.

If, in the determination of step S51, the measured value of the water temperature is abnormal, the MPU 51 advances to the processing of step S53.

If, in the determination of step S51, there is no abnormality in the value of the water temperature that corresponds to the temperature data transmitted from the external sensor unit 5A and in the value of the water temperature measured by the temperature sensor 63, the MPU 51 overwrites and stores in the RAM 54 the value of the water temperature that corresponds to the temperature data transmitted from the external sensor unit 5A and the value of the water temperature measured by the temperature sensor 63 (step S52).

Next, the MPU 51 determines whether diving has ended based on the output signal of the diving operation monitoring switch 12 (step S53).

If diving has not ended in the determination of step S53, the MPU 51 once again shifts the processing to step S50 and performs the same processing thereafter.

If diving has ended in the determination of step S53, the MPU 51 carries out processing to confirm (step S54) the diving log information (diving history), and the processing to store information is ended (step S55).

In the second water temperature recording routine as described above, if there is an abnormality in the water temperature measured by the temperature sensor 63 or in the value of the water temperature that corresponds to the temperature data transmitted from the external sensor unit 5A, the water temperature is not recorded as log information, and meaningless temperature information is not recorded as log information because the water temperature is recorded as log information only when a normal water temperature can be measured.

[2.1.3] Third Water Temperature Recording Routine

Described next as a water temperature recording routine is the case in which the third water temperature recording routine is carried out to record a log while updating the water temperature in the RAM 54 when the temperature sensor 63 of the second temperature measuring unit 62 or the first temperature measuring unit 47 of the external sensor unit 5A have stabilized, the temperature can be measured, and the maximum depth or the lowest temperature has been reached.

Figure 13:
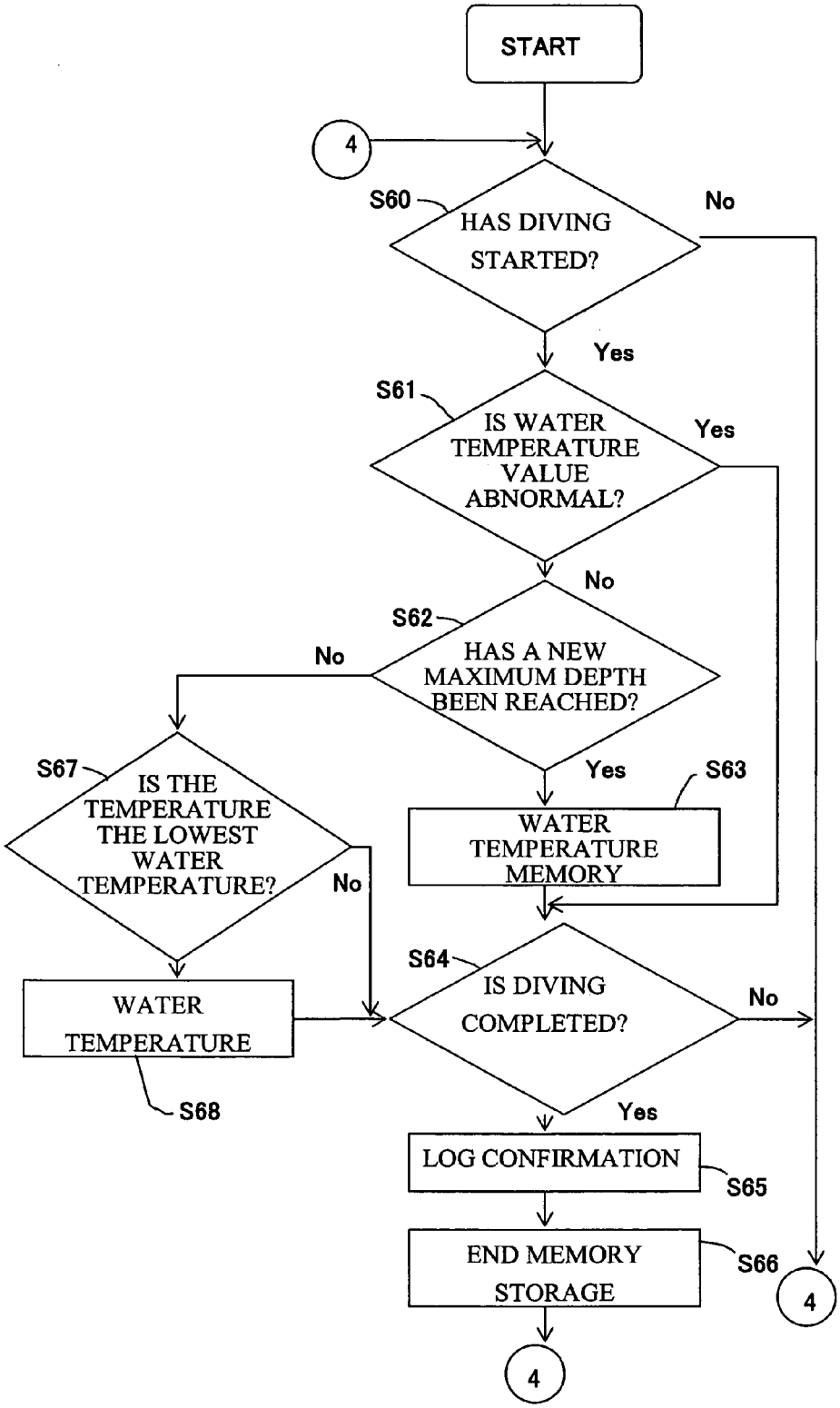
FIG. 13 is a processing flowchart of a third water temperature recording routine.

FIG. 13 is a processing flowchart of the third water temperature recording routine.

First, the MPU 51 determines whether the dive has started on the basis of the output signal of the diving operation monitoring switch 12 (step S60).

The MPU 51 enters a standby state if it has been determined in step S60 that the dive has not started.

If the MPU 51 has determined that the dive has started in the determination of step S60, a determination is made (step S61) whether there is an abnormality in the value of the water temperature that corresponds to the temperature data transmitted from the external sensor unit 5A or in the value of the water temperature measured with the temperature sensor 63.

If, in the determination of step S61, there is an abnormality in the measured value of the water temperature measured by the temperature sensor 63 or the first temperature measuring unit 47, the MPU 51 advances to the processing of step S64.

If, in the determination of step S61, the measured value of the water temperature is not abnormal; in other words, if the measured value of the water temperature is normal, the MPU 51 determines (step S62) whether a new maximum depth has been reached on the basis of the output signal for the pressure measuring unit 61 or the pressure data transmitted from the external sensor unit 5A.

If it has been determined that a new maximum depth has been reached in the determination of step S62, the MPU 51 overwrites and stores (step S63) in the RAM 54 the value of the water temperature measured with either the temperature sensor 63 or the first temperature measuring unit 47.

Next, the MPU 51 determines whether diving has ended based on the output signal of the diving operation monitoring switch 12 (step S64).

If it has been determined that diving has not ended in the determination of step S64, the MPU 51 once again shifts the processing to step S60 and performs the same processing thereafter.

If it has been determined that diving has ended in the determination of step S62, the MPU 51 determines (step S67) whether the water temperature measured by the temperature sensor 63 or the first temperature measuring unit 47 is the lowest temperature during the dive.

If it has been determined that the measured water temperature is the lowest temperature of the dive in the determination of step S67, the MPU 51 overwrites and stores (step S63) in the RAM 54 the value of the water temperature measured with the temperature sensor 63 or the first temperature measuring unit 47, and determines whether diving has ended based on the output signal of the diving operation monitoring switch 12 (step S64).

If it has been determined that diving has ended in the determination of step S64, the MPU 51 carries out processing to confirm (step S65) the diving log information (diving history), and the processing to store information is ended (step S66).

In the third water temperature recording routine as described above, if the water temperature measured by the temperature sensor 63 is abnormal, the water temperature is not recorded as log information, and meaningless temperature information is not recorded as log information because the water temperature is recorded as log information only when a normal water temperature can be measured and a new maximum depth or a new lowest temperature has been reached.

[2.1.4] Fourth Water Temperature Recording Routine

Described next as a water temperature recording routine is the case in which the fourth water temperature recording routine is carried out to record progressively a log while updating the temperature in the RAM 54 until a preset acclimation time has elapsed in a manner such that the temperature sensor 63 of the second temperature measuring unit 62 or the first temperature measuring unit 47 of the external sensor unit 5A has stabilized and the temperature can be measured; and to record the lowest water temperature as a log after the acclimation time has elapsed.

Figure 14:
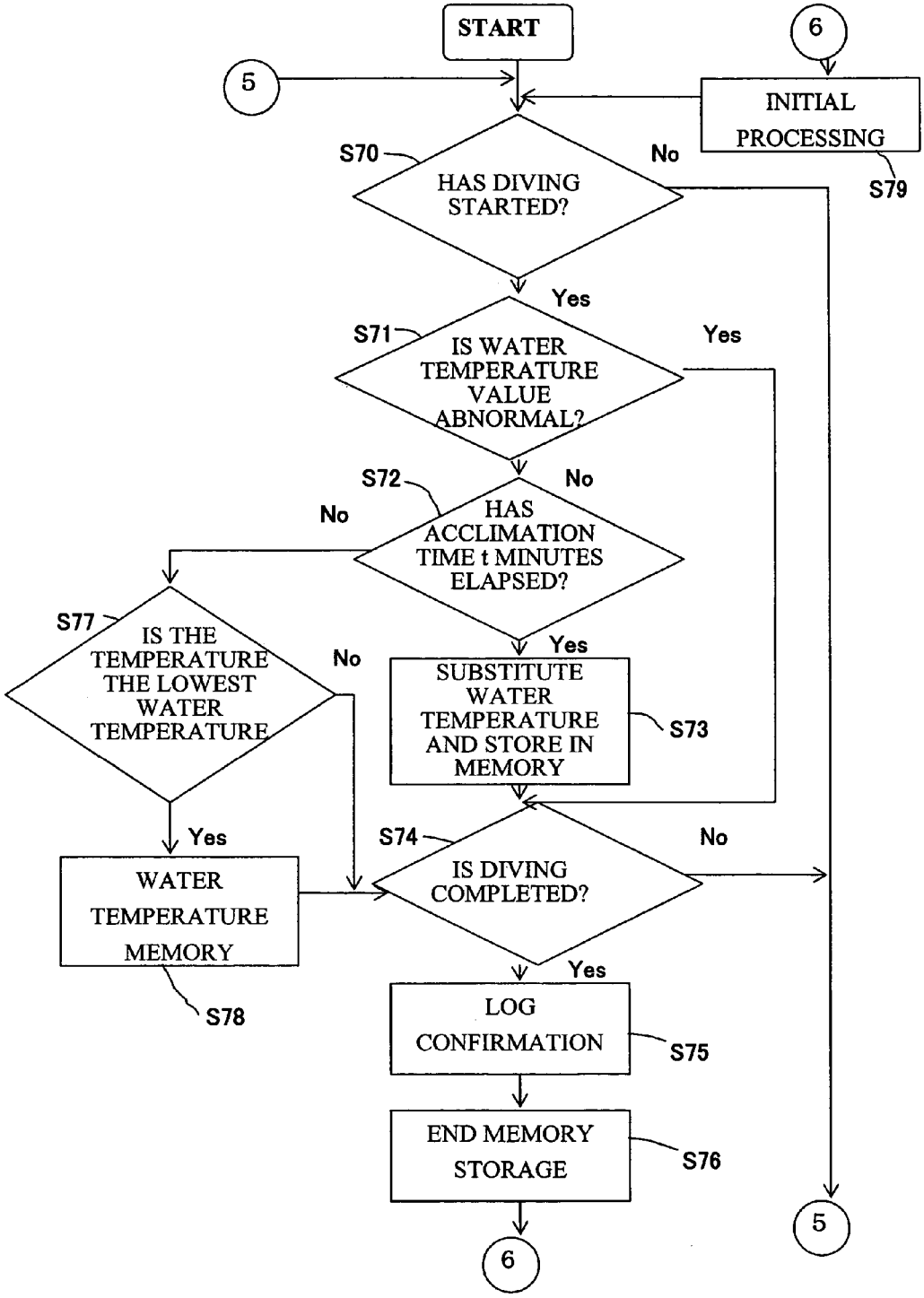
FIG. 14 is a processing flowchart of a fourth water temperature recording routine.

FIG. 14 is a processing flowchart of the fourth water temperature recording routine.

First, the MPU 51 determines whether the dive has started on the basis of the output signal of the diving operation monitoring switch 12 (step S70).

The MPU 51 enters a standby state if it has been determined in step S70 that the dive has not started.

When the MPU 51 has determined that the dive has started in the determination of step S70, a determination is made (step S71) whether there is an abnormality in the value of the water temperature that corresponds to the temperature data transmitted from the external sensor unit 5A or in the value of the water temperature measured with the temperature sensor 63.

If it has been determined in the determination of step S71 that there is an abnormality in the measured value of the water temperature that corresponds to temperature data transmitted from the external sensor unit 5A or in the value of the water temperature measured with the temperature sensor 63, the MPU 51 advances to the processing of step S74.

If, in the determination of step S71, the measured value of the water temperature is not abnormal; in other words, if the measured value of the water temperature is normal, the MPU 51 determines (step S72) whether the acclimation times of t minutes have elapsed, in other words, whether the temperature measured by the temperature sensor 63 and the first temperature measuring unit 47 has stabilized in an equilibrium state.

If it has been determined in the determination of step S72 that t minutes have not yet elapsed as the acclimation time of the temperature sensor 63 and the first temperature measuring unit 47, the MPU 51 overwrites and stores (step S73) in the RAM 54 the value of the water temperature measured with the temperature sensor 63 and the first temperature measuring unit 47, and determines whether diving has ended based on the output signal of the diving operation monitoring switch 12 (step S74).

If it has been determined that diving has not ended in the determination of step S74, the MPU 51 once again shifts the processing to step S70, and performs the same processing thereafter.

If it has been determined in the determination of step S72 that t minutes have already elapsed as the acclimation times of the temperature sensor 63 and the first temperature measuring unit 47, the MPU 51 determines (step S77) whether the water temperature measured by the temperature sensor 63 or the first temperature measuring unit 47 is the lowest temperature during the dive.

If it has been determined that the measured water temperature is the lowest temperature of the dive in the determination of step S77, the MPU 51 overwrites and stores (step S78) in the RAM 54 the value of the water temperature measured with the temperature sensor 63 and the first temperature measuring unit 47, and determines whether diving has ended based on the output signal of the diving operation monitoring switch 12 (step S74).

If it has been determined that diving has ended in the determination of step S74, the MPU 51 carries out processing to confirm (step S75) the diving log information (diving history), ends the routine to store information (step S76), carries out an initialization routine (step S79), once again shifts the processing to step S70, and thereafter carries out the same processing.

If it has been determined that diving has not ended in the determination of step S74, the processing is once again shifted to step S70, and the same processing is performed thereafter.

In the fourth water temperature recording routine as described above, the water temperature to be recorded as log information is progressively updated with the actual measurement temperature until the acclimation times of the temperature sensor 63 and the first temperature measuring unit 47 have elapsed, and after the acclimation times have elapsed, the lowest temperature is recorded, so log information related to the water temperature can be made more accurate.

[2.1.5] Fifth Water Temperature Recording Routine

Described next as a water temperature recording routine is the case in which the fifth water temperature recording routine is carried out to not record the water temperature as a log if it has been determined that the temperature displacement of the measured temperature per unit of time has exceeded a prescribed temperature displacement and the water temperature value is abnormal; and to record progressively a log while updating the temperature in the RAM 54 when the temperature displacement of the measured temperature per unit of time is equal to or less than a prescribed temperature displacement and a normal water temperature value can be measured.

Figure 15:
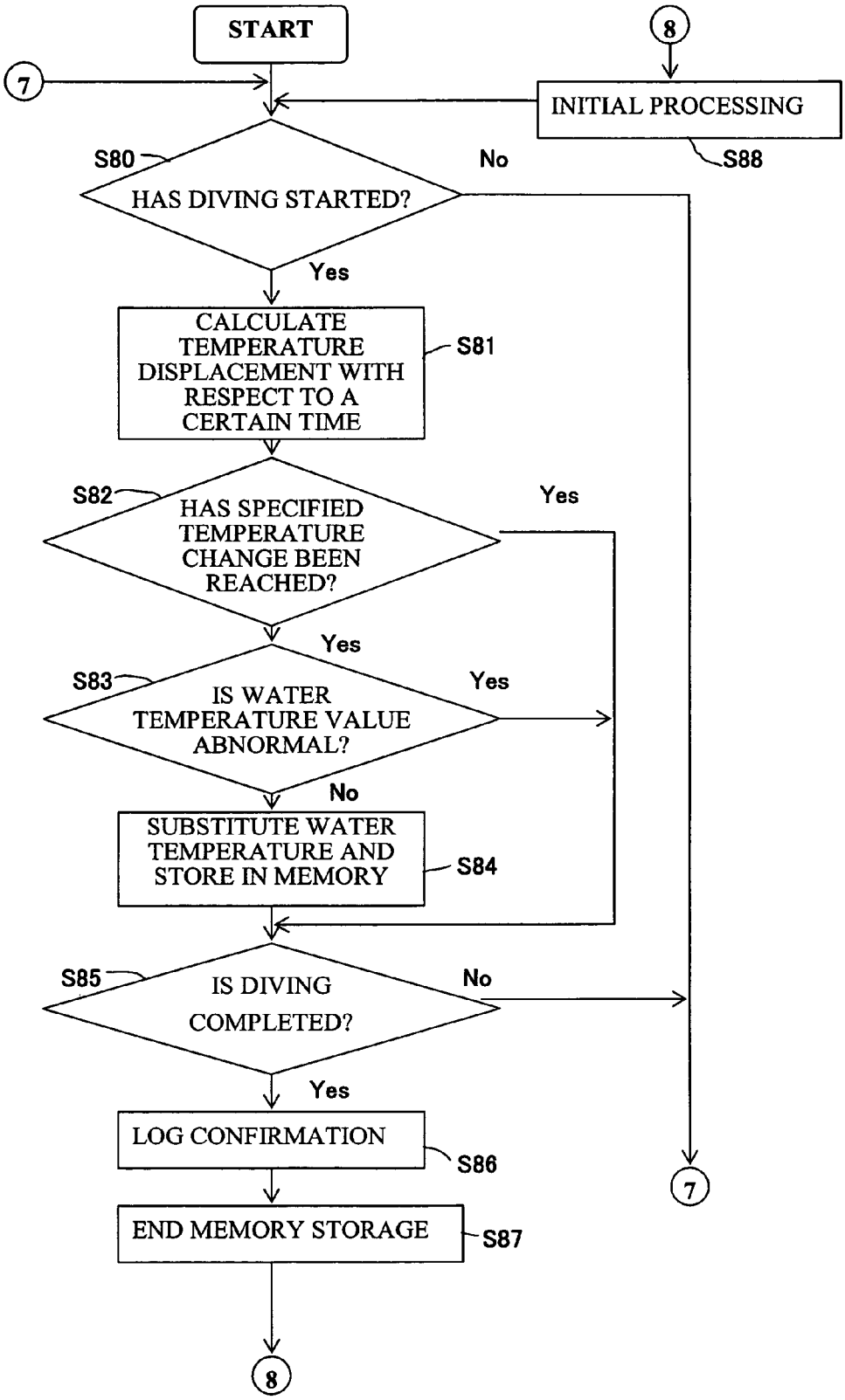
FIG. 15 is a processing flowchart of a fifth water temperature recording routine.

FIG. 15 is a processing flowchart of the fifth water temperature recording routine.

First, the MPU 51 determines whether the dive has started on the basis of the output signal of the diving operation monitoring switch 12 (step S80).

The MPU 51 enters a standby state if it has been determined in step S80 that the dive has not started.

If it has been determined that the dive has started in the determination of step S80, the MPU 51 calculates (step S81) the temperature displacement at predetermined times (unit time) on the basis of the water temperature that corresponds to the temperature data transmitted from the external sensor unit 5A and the water temperature measured with the temperature sensor 63.

Next, the MPU 51 determines (step S82) whether the temperature displacement in step S81 has reached (or exceeded) a preset temperature displacement (threshold temperature displacement). In other words, a determination is made whether the temperature displacement of the temperature sensor 63 or the first temperature measuring unit 47 is considerable and a stable water temperature measurement cannot be performed.

If it has been determined that temperature displacement has reached (exceeded) a prescribed temperature displacement in the determination of step S82, the MPU 51 shifts the processing to step S85.

If it has been determined that temperature displacement has not reached (not exceeded) a prescribed temperature displacement in the determination of step S82, the MPU 51 determines whether the measured value of the water temperature is abnormal (step S83).

If it has been determined in the determination of step S83 that the value of the water temperature measured with the temperature sensor 63 and the first temperature measuring unit 47 is abnormal, the MPU 51 advances to the processing of step S85.

If, in the determination of step S83, the measured value of the water temperature is not abnormal, in other words, if the measured value of the water temperature is normal, the MPU 51 overwrites and stores (step S84) in the RAM 54 the value of the water temperature measured with the temperature sensor 63 or the first temperature measuring unit 47, and determines whether diving has ended based on the output signal of the diving operation monitoring switch 12 (step S85).

If it has been determined that diving has ended in the determination of step S85, the MPU 51 carries out processing to confirm (step S86) the diving log information (diving history), ends the routine to store information (step S87), carries out an initialization routine (step S88), once again shifts the processing to step S80, and thereafter carries out the same processing.

If it has been determined that diving has not ended in the determination of step S85, the MPU 51 once again shifts the processing to step S80 and performs the same processing thereafter.

In the fourth water temperature recording routine as described above, the water temperature is progressively updated in the RAM 54 and recorded as log information when the temperature displacement of the measured temperature per unit of time is equal to or less than a prescribed temperature displacement and a normal water temperature value can be measured. If it has been determined that the temperature displacement of the measured temperature per unit of time has exceeded a prescribed temperature displacement and the water temperature value is abnormal, the water temperature is not recorded as log information, so log information related to the water temperature can be made more accurate.

[2.1.6] Sixth Water Temperature Recording Routine

Described next as a water temperature recording routine is the case in which the sixth water temperature recording routine is carried out not to record log information if it has been determined that the temperature displacement of the measured temperature per unit of time has exceeded a prescribed temperature displacement, that a preset acclimation time has elapsed so that the temperature sensor 63 of the second temperature measuring unit 62 has stabilized and the temperature can be measured, and that the water temperature value is still abnormal; thereafter to record progressively corrected water temperature as a log while updating the temperature in the RAM 54 until a normal water temperature value can be measured; and to record progressively the water temperature while updating the temperature in the RAM 54 when a normal water temperature value can be measured.

Figure 16:
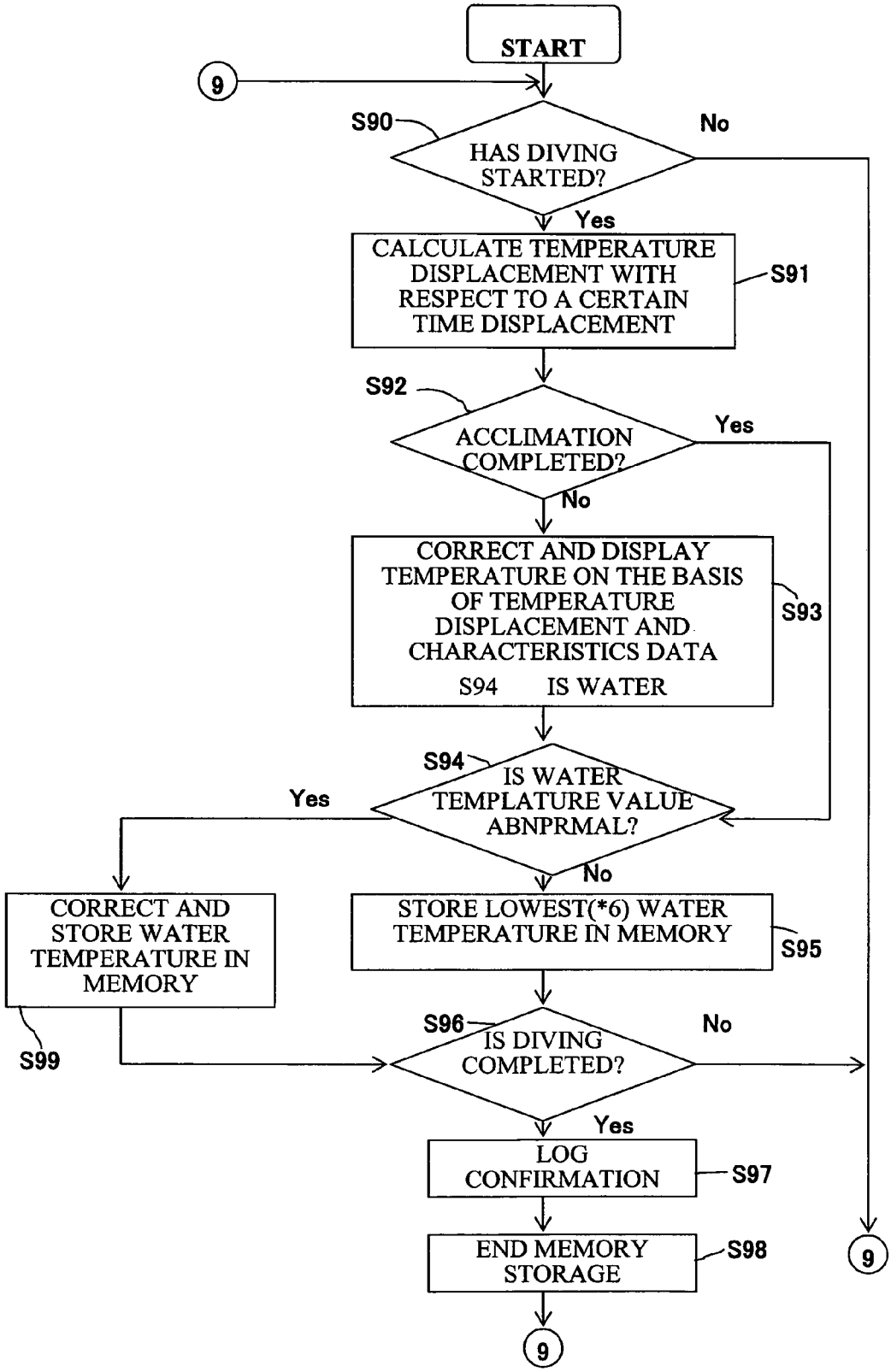
FIG. 16 is a processing flowchart of a sixth water temperature recording routine.

FIG. 16 is a processing flowchart of the sixth water temperature recording routine.

First, the MPU 51 determines whether the dive has started on the basis of the output signal of the diving operation monitoring switch 12 (step S90).

The MPU 51 enters a standby state if it has been determined in step S90 that the dive has not started.

If it has been determined that the dive has started in the determination of step S90, the MPU 51 calculates (step S91) the temperature displacement at predetermined times (unit time) on the basis of the water temperature that corresponds to the temperature data transmitted from the external sensor unit 5A and the water temperature measured with the temperature sensor 63.

Next, the MPU 51 determines (step S92) whether t minutes have elapsed as the acclimation time of the temperature sensor 63 and the first temperature measuring unit 47; in other words, whether the values being measured by the temperature sensor 63 and the first temperature measuring unit 47 have stabilized in an equilibrium state.

If it has been determined in the determination of step S92 that t minutes have not yet elapsed as the acclimation time of the temperature sensor 63 and the first temperature measuring unit 47, the MPU 51 corrects the temperature on the basis of the measured temperature displacement and the characteristic data of the temperature sensor 63 or the characteristic data of the first temperature measuring unit 47, displays (step S93) the temperature after corrections, and shifts processing to step S94, and determines (step S94) whether the measured value of the water temperature is abnormal.

If t minutes have already elapsed as the acclimation time of the temperature sensor 63 or the first temperature measuring unit 47 in the determination of step S92, a determination is made whether the measured value of the water temperature is abnormal (step S94).

If the measured value of the water temperature is abnormal in the determination of step S94, the MPU 51 overwrites and stores the water temperature measured with the temperature sensor 63 or the first temperature measuring unit 47 in the RAM 54, and shifts the processing to step S96.

If, in the determination of step S94, the measured value of the water temperature is not abnormal, in other words, if the measured value of the water temperature is normal, the MPU 51 overwrites and stores the water temperature in the RAM 54 when the water temperature measured with the temperature sensor 63 or the water temperature measured with the first temperature measuring unit 47 is the lowest temperature, and when this is not the case, the measured water temperature is discarded (step S95) and a determination is made as to whether diving has ended based on the output signal of the diving operation monitoring switch 12 (step S96).

If it has been determined that diving has not ended in the determination of step S96, the MPU 51 once again shifts the processing to step S90 and performs the same processing thereafter.

If it has been determined that diving has ended in the determination of step S96, the MPU 51 carries out processing to confirm (step S97) the diving log information (diving history), ends the routine to store information (step S98), once again shifts the processing to step S90, and carries out the same processing thereafter. If it has been determined that diving has not ended in the determination of step S96, the MPU 51 once again shifts the processing to step S90 and performs the same processing thereafter.

In the sixth water temperature recording routine as described above, a log is not recorded if it has been determined that the temperature displacement of the measured temperature per unit of time has exceeded a reference temperature displacement, that the preset acclimation time has elapsed so that the temperature sensor 63 of the second temperature measuring unit 62 or the first temperature measuring unit 47 of the external sensor unit SA has stabilized and the temperature can be measured, and that the water temperature value is abnormal; the corrected water temperature is thereafter recorded as a log while updated in the RAM 54 until a normal water temperature value can be measured; and the water temperature is progressively recorded as a log while updated in the RAM 54 when a normal water temperature value can be measured. Therefore, the log information related to water temperature can be measured with greater accuracy, the accuracy of the display can be improved, and more highly accurate information can be given to the diver.

[2.2] Effects of the Second Embodiment

In the present second embodiment as described above, the log information related to water temperature can be made more accurate, and by being aware, for example, of the lowest temperature on the day (season) in which diving was performed, information can be accurately obtained to determine what diving form (wet suit, dry suit, or other equipment) should be used during the next dive.

[2.3] Modification of the Second Embodiment

In the description above, methods to store water temperature in a log (diving history) were described, but the water temperature may also be stored in a profile. Profile information essentially leaves a record of the depth at set time intervals or each reference time interval. In other words, the diving pattern can be checked after the dive, the information can be used as reference information for later dives, and the pattern of temperature change can be ascertained simultaneously with the diving pattern by simultaneously storing the water temperature.

In the description above, the case in which the dive computer and the external sensor unit are jointly used was described, but also possible is a configuration that does not include an external sensor.

As a specific aspect, the dive computer may be configured with a temperature storage control unit to store as log information or profile information temperature information that corresponds to the output of the temperature sensor after the measured temperature output acquired from the temperature sensor has reached a stable state.

In accordance with the above-described configuration, the temperature sensor measures the ambient water temperature. The temperature storage control unit stores as log information or profile information temperature information that corresponds to the output of the temperature sensor after the measured temperature output acquired from the temperature sensor has reached a stable state.

In this case, the temperature storage control unit may be configured so as to conclude that a stable condition has been reached once a preset acclimation time correlated with the temperature sensor has elapsed.

The temperature storage control unit may be configured to conclude that a stable condition has been reached in a state in which the output of the temperature sensor has reached a normal water temperature value.

The temperature storage control unit may be configured to conclude that a stable condition has been reached when the output of the temperature sensor has reached a state corresponding to a normal water temperature value.

The temperature storage control unit may be configured to conclude that a stable condition has been reached when the amount of temperature displacement of the measured temperature per unit of time is equal to or less than a reference amount of temperature displacement.

The temperature storage control unit may be configured to store as log information or profile information temperature information that corresponds to the lowest water temperature, or temperature information that corresponds to the water temperature at the maximum depth after a stable state has been reached.

The temperature storage control unit may be configured to prevent the storage of temperature information as log information or profile information until a stable state has been reached.

The temperature storage control unit may be configured to store progressively as log information or profile information temperature information that corresponds to the output of the temperature sensor until a stable state has been reached.

In another aspect of the method to control an information processing device for a diver which has a temperature sensor to measure the ambient water temperature and a temperature storage unit to store log information or profile information, there may be provided a temperature measuring step to measure the ambient water temperature with the temperature sensor, and a temperature storage control step to store as log information or profile information temperature information that corresponds to the output of the temperature sensor after the measured temperature output acquired from the temperature sensor has reached a stable state.

In another aspect of the control program for the computer control of a dive computer which has a temperature sensor to measure the ambient water temperature and a temperature storage unit to store log information or profile information, it is possible to measure the ambient water temperature with the temperature sensor, and to store as log information or profile information temperature information that corresponds to the output of the temperature sensor after the measured temperature output acquired from the temperature sensor has reached a stable state.

In this case, it may be concluded that a stable condition has been reached once a preset acclimation time correlated with the temperature sensor has elapsed.

It may also be concluded that a stable condition has been reached in a state in which the output of the temperature sensor has reached a normal water temperature value.

It may furthermore be concluded that a stable condition has been reached when the output of the temperature sensor has reached a state corresponding to a normal water temperature value.

It may additionally be concluded that a stable condition has been reached when the amount of temperature displacement of the measured temperature per unit of time is equal to or less than a reference amount of temperature displacement.

It is also possible to store as log information or profile information the temperature information corresponding to the lowest water temperature, or temperature information that corresponds to the water temperature at the maximum depth after a stable state has been reached.

It is further possible to prevent the storage of temperature information as log information or profile information until a stable state has been reached.

It is additionally possible to store progressively as log information or profile information temperature information that corresponds to the output of the temperature sensor until a stable state has been reached.

It is also possible to adopt an aspect in which the control programs are recorded on a computer-readable recording medium.

In accordance with the above-described aspects, it is possible to improve the accuracy of the log information or the profile information related to water temperature, and hence to make the necessary modifications for the next dive.

[3] Modified Embodiments

The above descriptions dealt with cases in which the control programs to control the dive computer were stored in the ROM in advance, but also possible is a configuration in which the control programs are prerecorded on various types of magnetic disks, optical disks, memory cards, or other recording media, read from the recording media by way of a communication cable or other cable, and installed. Also possible is a configuration in which a communication interface is provided, and the control programs are downloaded by way of the Internet, LAN, or another network, and are installed and executed. In such configurations, it is possible to achieve enhanced functionality through software, and to provide a dive computer with greater reliability.

Cases in which the dive computer was worn on the wrist were described above, but the present invention is not limited thereby and may be modified such that the dive computer is embedded in the diving suit, worn about the waist, mounted on the diving mask, or the like.

"Front," "back," "up," "down," "vertical," "horizontal," "orthogonal," and other terms used in the above description that indicate direction refer to the directions of an information processing device for a diver or the directions of diving equipment to which the present invention is adapted. Therefore, the terms indicating these directions that are used to describe the present invention should be interpreted with respect to an information processing device for a diver or with respect to diving equipment to which the present invention is adapted.

"Substantially," "essentially," "about," and other terms that represent an approximation indicate a reasonable amount of deviation that does not bring about a considerable change as a result. Terms that represent these approximations should be interpreted so as to include an error of about ±5% at least, as long as there is no considerable change due to the diviation.

Only some embodiments of the present invention are cited in the above description, but it is apparent to those skilled in the art that it is possible to add modifications to the above-described embodiments by using the above-described disclosure without exceeding the range of the present invention as defined in the claims. The above-described embodiments furthermore do not limit the range of the present invention, which is defined by the accompanying claims or equivalents thereof, and is solely intended to provide a description of the present invention.

What is claimed is:

1. An information processing device worn by a diver comprising:

an environment information measuring unit being worn in a first wearing location on the diver, having a first sensor being configured to measure environment information, and transmitting environment information data; and a safety-ensuring information generating unit being worn by the diver in a second location different from said first wearing location receiving said environment information data from said environment information measuring unit, and generating and outputting safety-ensuring information to ensure the safety of the diver on the basis of said environment information data, said safety-ensuring information generating unit having a second sensor being configured to measure environment information.

2. An information processing device worn by a diver comprising:

an environment information measuring unit being worn in a first wearing location on the diver measuring environment information, and transmitting environment information data; and a safety-ensuring information generating unit being worn by the diver in a second location different from said first wearing location receiving said environment information data from said environment information measuring unit, and generating and outputting safety-ensuring information to ensure the safety of the diver on the basis of said environment information data, said first wearing location being the diver's ankle.

3. The information processing device according to claim 1, wherein said environment information measuring unit has a transmitter unit to transmit said environment information data, and said safety-ensuring information generating unit has a receiver unit to receive said environment information data.

4. The information processing device according to claim 3, wherein said transmitter unit transmits ultrasonic wave communication signals, and said safety-ensuring information generating unit receives said ultrasonic wave communication signals.

5. The information processing device according to claim 1, wherein said safety-ensuring information generating unit further has a sound alarm to warn the diver with a sound, an oscillation generator to warn the diver with vibrations, a pressure gauge to measure water pressure, a temperature measuring unit to measure temperature, and a timer to carry out timer routines.

6. The information processing device according to claim 1, wherein said environment information measuring unit further has a pressure gauge to detect pressure, and said transmitter unit transmits detected pressure data.

7. The information processing device according to claim 6, wherein said environment information measuring unit further has a timing determining unit to determine said transmission timing of the pressure data from said transmitter unit.

8. The information processing device according to claim 6, wherein said environment information measuring unit has a temperature measuring unit to detect temperature, and said transmitter unit transmits detected temperature data.

9. The information processing device according to claim 1, wherein said environment information measuring unit further has a first temperature measuring unit to detect temperature and obtain first temperature data, said transmitter unit transmits said first temperature data, and said safety-ensuring information generating unit has a second temperature measuring unit to detect temperature and to obtain second temperature data, and a water temperature to record unit for recording water temperature when either said first temperature data or said second temperature data are within a normal range.

10. The information processing device according to claim 9, wherein said water temperature recording unit records temperature after said first and second temperature measuring units have reached a stable state.

11. The information processing device according to claim 10, wherein said water temperature recording unit concludes that a stable state has been reached once a preset acclimation time has elapsed in accordance with said first and second temperature measuring units.

12. The information processing device according to claim 10, wherein said water temperature recording unit concludes that a stable condition has been reached once said output of said first and second temperature measuring units has reached a state corresponding to a normal water temperature value.

13. The information processing device according to claim 10, wherein said water temperature recording unit concludes that a stable condition has been reached when an amount of temperature displacement of measured temperature per unit of time is equal to or less than a predetermined amount of temperature displacement on the basis of said output of said first and second temperature measuring units.

14. The information processing device according to claim 1, wherein said environment information measuring unit further has a first temperature measuring unit to detect temperature and to obtain first temperature data, and a first pressure gauge to detect pressure and to obtain first pressure data, said transmitter unit transmits first temperature data and first pressure data, and said safety-ensuring information generating unit has a second temperature measuring unit to detect temperature and to obtain second temperature data, a second pressure measuring unit to detect pressure and to obtain second pressure data, and a water temperature to recording unit to record water temperature on the basis of said first and second temperature data when a new maximum depth has been reached based on said first and second pressure data.

15. The information processing device according to claim 14, wherein said water temperature recording unit records the water temperature when either said first temperature data or said second temperature data are within a normal range.

16. The information processing device according to claim 1, wherein said environment information measuring unit further has a first temperature measuring unit to detect temperature and to obtain first temperature data, and a first pressure gauge to detect pressure and to obtain first pressure data, said transmitter unit transmits said first temperature data and said first pressure data, and said safety-ensuring information generating unit has a second temperature measuring unit to detect temperature and to obtain second temperature data, a second pressure measuring unit to detect pressure and to obtain second pressure data, and a water temperature recording unit to record water temperature on the basis of said first and second temperature data when a new maximum depth has been reached based on said first and second pressure data, or when a new lowest water temperature has been reached based on said first and second temperature data.

17. An information processing device worn by a diver comprising:

an environment information measuring unit being worn on the diver's ankle and having a first temperature measuring unit to detect the temperature and to obtain first temperature data, a first pressure gauge to detect the pressure and to obtain first pressure data, a transmitter unit to transmit first temperature data and first pressure data as an ultrasonic wave signal, and a timing determining unit to determine transmission timing produced by the transmitter unit; and a safety-ensuring information generating unit being worn on the diver's wrist and having a second temperature measuring unit to detect temperature and to obtain second temperature data, a second pressure measuring unit to detect pressure and to obtain second pressure data, a water temperature recording unit to record water temperature on the basis of said first and second temperature data when a new maximum depth has been reached based on said first and second pressure data, or when a new lowest water temperature has been reached based on said first and second temperature data, a sound alarm to notify the diver with a sound, a vibration generator to notify the diver with vibrations, a pressure gauge to measure the water pressure, a temperature measuring unit to measure temperature, and a timer to carry out timer routines.

18. An information processing device worn by a diver comprising:

environment information measuring means for being worn in a first wearing location on the diver and having a first sensor being configured for measuring environment information and transmitting environment information data; and safety-ensuring information generating means for being worn by the diver in a second location different from said first wearing location and for receiving said environment information data from said environment information measuring means, and for generating and outputting safety-ensuring information to ensure the safety of the diver on the basis of said environment information data, said safety-ensuring information generating unit having a second sensor being configured to measure environment information.

19. The information processing device according to claim 18, wherein said environment information measuring means detects temperature to obtain first temperature data, and transmits said first temperature data, and said safety-ensuring information generating means measures temperature to obtain second temperature data, and records water temperature when either said first temperature data or said second temperature data are within a normal range.

20. The information processing device according to claim 18, wherein said environment information measuring means detects temperature to obtain first temperature data, detects pressure to obtain first pressure data, and transmits said first temperature data and said first pressure data, and second pressure measuring means measures temperature to obtain second temperature data, detects pressure to obtain second pressure data, and records water temperature on the basis of said first and second temperature data when a new maximum depth has been reached based on said first and second pressure data.

21. The information processing device according to claim 18, wherein said environment information measuring means detects temperature to obtain first temperature data, detects pressure to obtain first pressure data, and transmits said first temperature data and said first pressure data, and second pressure measuring means measures temperature to obtain second temperature data, detects pressure to obtain second pressure data, and records water temperature on the basis of said first and second temperature data when a new maximum depth has been reached based on said first and second pressure data, or when a new lowest water temperature has been reached based on said first and second temperature data.

22. An information processing device worn by a diver comprising:

environment information measuring means for being worn in a first wearing location on the diver and for measuring environment information and transmitting environment information data; and safety-ensuring information generating means for being worn by the diver in a second location different from said first wearing location and for receiving said environment information data from said environment information measuring means, and for generating and outputting safety-ensuring information to ensure the safety of the diver on the basis of said environment information data, said second location being the diver's wrist and said first wearing location being the diver's ankle.

23. An information processing method for a diver, comprising:

measuring environment information at a first wearing location on the diver by a first sensor, and transmitting environment information data; and receiving environment information data at a second location different from said first wearing location, and generating and outputting safety-ensuring information to ensure the safety of the diver on the basis of said environment information data, configuring at said second location a second sensor to measure environment information.

24. The information processing method according to claim 23, wherein measuring environment information includes detecting temperature to obtain first temperature data, and transmitting said first temperature data, and generating and outputting safety-ensuring information includes measuring temperature to obtain second temperature data, and recording water temperature when either said first temperature data or said second temperature data are within a normal range.

25. The information processing method according to claim 23, wherein measuring environment information includes detecting temperature and obtaining first temperature data, detecting the pressure and obtaining first pressure data, and transmitting said first temperature data and said first pressure data, and generating and outputting safety-ensuring information includes detecting said temperature and obtaining second temperature data, detecting pressure and obtaining second pressure data, and recording water temperature on the basis of said first and second temperature data when a new maximum depth has been reached based on said first and second pressure data.

26. The information processing method according to claim 23, wherein measuring environment information includes detecting temperature and obtaining first temperature data, detecting pressure and obtaining first pressure data, and transmitting said first temperature data and said first pressure data, and generating and outputting safety-ensuring information includes detecting temperature and obtaining second temperature data, detecting pressure and obtaining second pressure data, and recording water temperature on the basis of said first and second temperature data when a new maximum depth has been reached based on said first and second pressure data, or when a new lowest water temperature has been reached based on said first and second temperature data.

27. An information processing method for a diver, comprising:

measuring environment information at a first wearing location on the diver, and transmitting environment information data; and receiving environment information data at a second location different from said first wearing location, and generating and outputting safety-ensuring information to ensure the safety of the diver on the basis of said environment information data, said second location being the diver's wrist and said first wearing location being the diver's ankle.

* * * * *